US007976139B2

(12) United States Patent
Kyoso et al.

(10) Patent No.: US 7,976,139 B2
(45) Date of Patent: Jul. 12, 2011

(54) LIQUID EJECTION HEAD AND LIQUID EJECTION APPARATUS

(75) Inventors: Tadashi Kyoso, Kanagawa-ken (JP); Masakazu Okuda, Ebina (JP)

(73) Assignees: Fujifilm Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 819 days.

(21) Appl. No.: 12/031,577

(22) Filed: Feb. 14, 2008

(65) Prior Publication Data

US 2008/0198208 A1 Aug. 21, 2008

(30) Foreign Application Priority Data

Feb. 16, 2007 (JP) ..... 2007-037015

(51) Int. Cl.
*B41J 2/175* (2006.01)

(52) U.S. Cl. ..... 347/85; 347/89

(58) Field of Classification Search ..... 347/85–87, 347/89–90, 17, 68
See application file for complete search history.

(56) References Cited

U.S. PATENT DOCUMENTS

2003/0011668 A1* 1/2003 Yoshida ..... 347/86
2008/0136860 A1* 6/2008 Kyoso ..... 347/19
2008/0198207 A1* 8/2008 Katada ..... 347/85
2008/0211841 A1* 9/2008 Kojima et al. ..... 347/9
2008/0238980 A1* 10/2008 Nagashima et al. ..... 347/17
2008/0309739 A1* 12/2008 Takahashi ..... 347/85

FOREIGN PATENT DOCUMENTS

JP 10-114081 A 5/1998

* cited by examiner

*Primary Examiner* — Ellen Kim
(74) *Attorney, Agent, or Firm* — Birch, Stewart, Kolasch & Birch, LLP

(57) ABSTRACT

A liquid ejection head includes: a plurality of nozzles which eject liquid; a plurality of pressure chambers connected respectively to the plurality of nozzles; a common flow channel which is provided to be shared by the plurality of pressure chambers and has a plurality of supply flow channel connection ports and a plurality of circulation flow channel ports; a plurality of supply flow channels through which the liquid flows from the common flow channel to the plurality of pressure chambers via the plurality of supply flow channel connection ports; and a plurality of circulation flow channels through which the liquid flow from the plurality of pressure chambers to the common flow channel via the plurality of circulation flow channel ports, wherein the plurality of supply flow channel connection ports and the plurality of circulation flow channel ports are arranged so that a pressure differential of the liquid between the supply flow channel connection port and the circulation flow channel port which are connected to the same pressure chamber is equal in respect of all of the plurality of pressure chambers.

12 Claims, 18 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus each of which has nozzles from which liquid such as ink can be ejected.

2. Description of the Related Art

A liquid ejection head having an ink supply structure which is able to prevent increase in the viscosity of the ink inside the nozzles is desired.

Japanese Patent Application Publication No. 10-114081 discloses a liquid ejection head comprising: two common ink preparation chambers (common flow channels) which are connected respectively to either side of pressure generating chambers, via ink supply ports; and ink introduction ports via which ink is introduced into the respective ink preparation chambers from the exterior. Of the two ink introduction ports, one ink introduction port is connected to a sub tank, and the other ink introduction port is connected to an ink cartridge, and printing is carried out, while ink is replenished into the sub tank by making the ink pass from the ink cartridge through the liquid ejection head and the ink then flows in reverse by making the ink pass from the sub tank to the ink cartridge through the liquid ejection head.

As shown in FIG. 20, the solvent in the ink evaporates from the meniscus of a nozzle 51 which is not ejecting ink, and hence there is a possibility that the viscosity of the ink increases. If the ink inside the nozzle 51 increases in viscosity, then the ejection speed declines and the image quality deteriorates. If the increase in viscosity increases further, then it becomes impossible to eject ink. If maintenance is carried out in order to remove the ink of increased viscosity by suction, it becomes possible to eject ink again, but in order to carry out maintenance of this kind, in general, it is necessary to halt printing, and therefore the apparatus operating time is reduced and printing costs increase.

Furthermore, in the apparatus described in Japanese Patent Application Publication No. 10-114081, if a pressure differential is applied between the two ink introduction ports which are provided in the ink preparation chamber (common flow chamber), then the flow rates of the ink flowing inside the respective pressure chambers differ. More specifically, a relatively large pressure differential is created on either side of a pressure chamber which is near to the ink introduction port, and a relatively small pressure differential is created on either side of a pressure chamber which is distant from the ink introduction port, and consequently, a relatively large amount of ink flows in a pressure chamber which is near to the ink introduction port, while a relatively small amount of ink flows in a pressure chamber which is distant from the ink introduction port.

If a difference arises in the ink flow rate between the pressure chambers, then not only is there a difference in the gas bubble expulsion properties between the pressure chambers, but furthermore, if the ink flows inside the pressure chamber during printing, then the effect of this ink flow on ejection will vary between the different pressure chambers, and therefore so-called "ejection variations" may arise.

Furthermore, in a liquid ejection head having a so-called matrix structure in which a plurality of nozzles are arranged at high density in order to achieve high image quality, it is difficult to increase the common flow channel in order to circulate the ink, for reasons of space.

SUMMARY OF THE INVENTION

The present invention has been contrived in view of these circumstances, an object thereof being to provide a liquid ejection head and a liquid ejection apparatus whereby increase in the viscosity of liquid in each nozzle can be prevented and ejection variations between nozzles can also be prevented.

One aspect of the present invention is directed to a liquid ejection head, comprising: a plurality of nozzles which eject liquid; a plurality of pressure chambers connected respectively to the plurality of nozzles; a common flow channel which is provided to be shared by the plurality of pressure chambers and has a plurality of supply flow channel connection ports and a plurality of circulation flow channel ports; a plurality of supply flow channels through which the liquid flows from the common flow channel to the plurality of pressure chambers via the plurality of supply flow channel connection ports; and a plurality of circulation flow channels through which the liquid flow from the plurality of pressure chambers to the common flow channel via the plurality of circulation flow channel ports, wherein the plurality of supply flow channel connection ports and the plurality of circulation flow channel ports are arranged so that a pressure differential of the liquid between the supply flow channel connection port and the circulation flow channel port which are connected to the same pressure chamber is equal in respect of all of the plurality of pressure chambers.

In this aspect of the invention, the supply flow channel connection ports and the circulation flow channel connection ports which are opened in the common flow channel are disposed in positions whereby the pressure differential in the liquid between supply flow channel connection port and the circulation flow channel port which are connected to the same pressure chamber is equal for all of the pressure chambers, and therefore it is possible to make the flow of liquid flowing in the pressure chamber equal in respect of all of the pressure chambers. Consequently, it is possible to make the effects of preventing increase in the viscosity of liquid and expelling gas bubbles equally in all of the pressure chambers, and therefore ejection variations between the nozzles can be prevented.

Desirably, a distance, in a direction of flow of the liquid in the common flow channel, between the supply flow channel connection port and the circulation flow channel port which are connected to the same pressure chamber, is equal in respect of all of the plurality of pressure chambers.

In this aspect of the invention, since the pressure differential in the liquid between the supply flow channel connection port and the circulation flow channel connection port which are connected to the same pressure chamber can readily be made equal in respect of all of the pressure chambers, then it is possible readily to make the flow of liquid flowing inside the pressure chamber equal in all of the pressure chambers. Consequently, it is possible readily to make the effects of preventing increase in the viscosity of liquid and expelling gas bubbles equally in all of the pressure chambers, and therefore ejection variations between the nozzles can be prevented.

Desirably, taking the distance between the supply flow channel connection port and the circulation flow channel port which are connected to the same pressure chamber to be L1, and taking a distance between the supply flow channel connection ports which are mutually adjacent and are connected respectively to the different pressure chambers, to be L2, then L1>L2 is satisfied.

In this aspect of the invention, it is possible to make the pressure differential (the back pressure differential) between the pressure chambers small, while maintaining a large volume of liquid flowing in the pressure chambers. It is also possible to increase the effects of preventing increase in the viscosity of liquid and the effects of expelling gas bubbles, while ensuring little ejection variation between the nozzles.

Desirably, the plurality of circulation flow channels are connected to lower portions of the common flow channel in terms of a vertical direction.

In this aspect of the invention, the gas bubbles in the common flow channel are not liable to enter into the nozzles and pressure chambers via the ink circulation flow channels, and therefore ejection abnormalities caused by the gas bubbles in the common flow channel are prevented.

Desirably, the plurality of supply flow channel connection ports and the plurality of circulation flow channel ports are arranged at substantially diagonally opposite positions of the common flow channel.

In this aspect of the invention, the liquid returning to the common flow channel via the ink circulation flow channels is prevented from being supplied directly to the pressure chambers via the ink supply flow channels, and therefore it is possible reliably to prevent increase in the viscosity of liquid.

Desirably, The liquid ejection head comprises a plurality of superimposed plates is including a nozzle plate in which the plurality of nozzles are formed and a circulation flow channel plate in which the plurality of circulation flow channels are formed, wherein the circulation flow channel plate is adjacent to the nozzle plate; and the common flow channel is formed in contact with the nozzle plate.

In this aspect of the invention, it is possible to make the liquid in the vicinity of the nozzle return to the common flow channel in order to maximize the effects in preventing increase in the viscosity of liquid, while also obtaining a damping capacity in the common flow channel with respect to cross talk between pressure chambers.

Desirably, a height of the plurality of circulation flow channels is smaller than a thickness of the circulation flow channel plate.

Here, the ink circulation flow channels may be formed by half etching the circulation flow channel plate, for example.

In this aspect of the invention, it is possible to increase the rigidity of the circulation flow channel forming plate and to preserve the shape of the circulation flow channels. Furthermore, since the flow channel resistance of the ink circulation flow channels is increased, then it is also possible to increase the ejection efficiency.

Desirably, the plurality of circulation flow channels are formed on a side adjacent to the nozzle plate, in terms of a thickness direction of the circulation flow channel plate.

In this aspect of the invention, not only does it become possible to improve the rigidity of the circulation flow channel forming plate and to preserve the shape of the circulation flow channels, but also the liquid in the vicinity of the nozzles can be circulated to the common flow channel, and therefore a beneficial effect in preventing increase in viscosity can be expected.

Desirably, rigid bodies are disposed in the common flow channel so as to surround the plurality of circulation flow channel connection ports.

In this aspect of the invention, it is possible to increase the rigidity of the circulation flow channel forming plate and to preserve the shape of the ink circulation flow channels, without using half etching.

Desirably, rigid bodies are disposed in the common flow channel, and each of the rigid bodies is arranged between the supply flow channel connection ports which are mutually adjacent.

In this aspect of the invention, it is possible to prevent the cross-talk waves which exit from the ink supply flow channel connection ports (ink supply ports), from striking directly against the rigid bodies, and therefore a damping effect with respect to cross-talk between the pressure chambers is obtained and the ejection stability is improved.

Another aspect of the present invention is directed to a liquid ejection apparatus comprising any one of the above-mentioned liquid ejection heads.

Desirably, the liquid ejection apparatus further comprises a liquid flow creating device which creates a flow of the liquid in the common flow channel while the liquid ejection head performs ejection of the liquid.

For example, the liquid flow creating device may be constituted by a pump which is provided in a tubular channel which is connected to the liquid ejection head.

In this aspect of the invention, an effect in supplementing the refilling of liquid into the pressure chambers is obtained.

According to the present invention, it is possible to prevent increase in the viscosity of liquid in the nozzles, while also being able to prevent ejection variations between the nozzles.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Liquid Ejection Head

Figure 1:
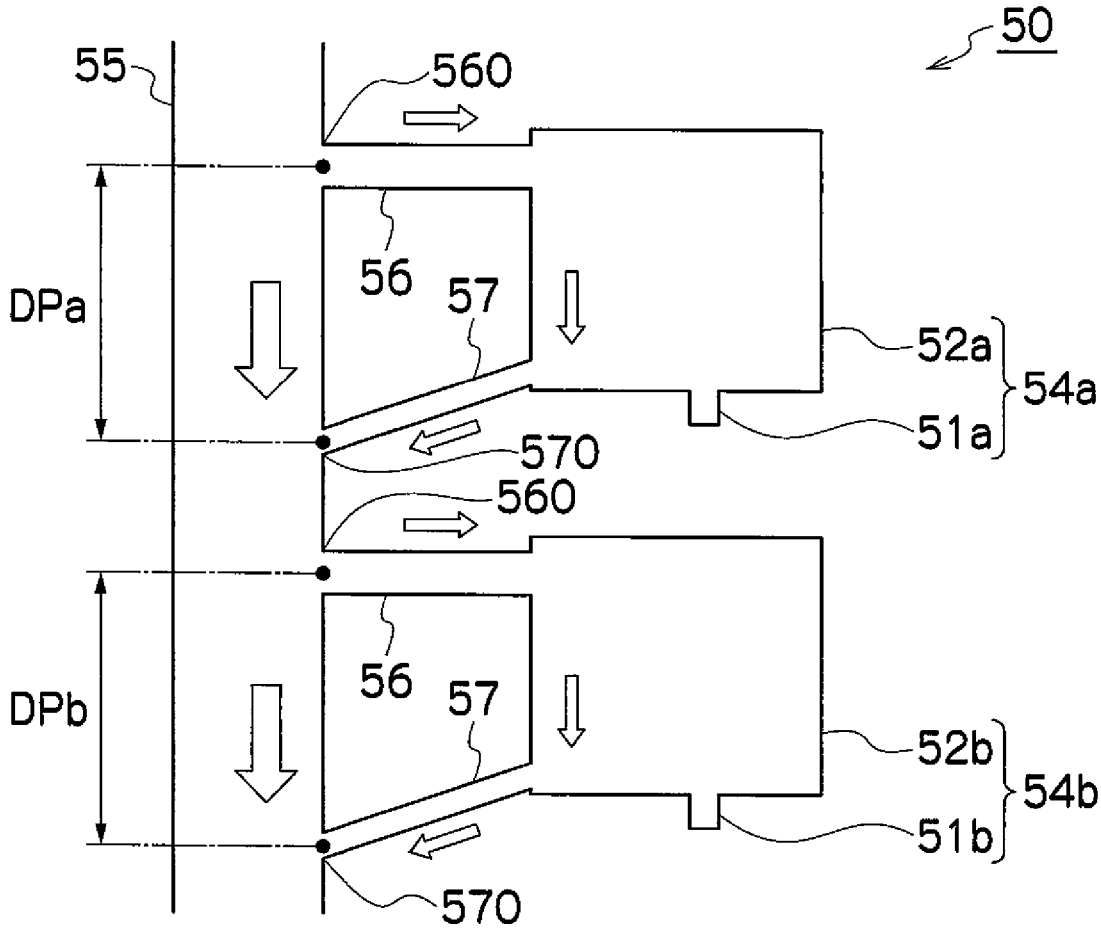
FIG. 1 is a perspective diagram showing the composition of a liquid ejection head relating to an embodiment of the present invention.

FIG. 1 is basic schematic drawing showing the basic composition of the principal part of a liquid ejection head relating to an embodiment of the present invention.

In FIG. 1, the liquid ejection head 50 comprises a plurality of nozzles 51 which eject ink (e.g. a first nozzle 51*a* and a second nozzle 51*b*), and a plurality of pressure chambers 52 which are connected respectively to these nozzles 51 (e.g. a first pressure chamber 52*a* and a second pressure chamber 52*b*). In other words, the liquid ejection head 50 comprises a plurality of ejectors 54 arranged suitably (e.g. a first ejector 54*a* and a second ejector 54*b*) each comprising a nozzle 51 and a pressure chamber 52 connected to the nozzle 51. FIG. 1 shows only two ejectors 54 in order to simplify the illustration, but there is no particular restriction on the number of ejectors 54. In other words, there is no particular restriction on the number of nozzles 51 and pressure chambers 52.

The common liquid chamber 55 is a flow channel which is provided commonly for a plurality of pressure chambers 52, and which supplies ink to the plurality of pressure chambers 52. The common flow channel 55 is disposed following an arrangement direction in which the pressure chambers 52 are aligned. In other words, a plurality of pressure chambers 52 are arranged following the direction of the flow of liquid in the common flow channel 55.

For each of the plurality of pressure chambers 52, an ink supply flow channel 56 which supplies ink from the common flow channel 55 to the pressure chamber 52, and an ink circulation flow channel 57 which returns ink from the pressure chamber 52 to the common flow channel 55, are formed between the pressure chamber 52 and the common flow channel 55. Below, connection ports 560 opened in the common flow channel 55 where they are connected with the ink supply flow channels 56 respectively are also called "ink supply ports" and connection ports 570 which are connected with the ink circulation flow channels 57 respectively are also called "ink circulation ports".

Looking specifically at the ink supply port 560 and the ink circulation port 570 which are connected to the same pressure chamber 52, the ink supply port 560 is disposed to the upstream side of the ink circulation port 570 in terms of the flow direction of the liquid in the common flow channel 55.

The cross-sectional area of the common flow channel 55 (the surface area of the cross-section perpendicular to the direction of flow of the liquid in the common flow channel 55) is the same for all of the pressure chambers 52, through the liquid flow direction, and the distance DPa between the ink supply port 560 and the ink circulation port 570 which are connected to a first pressure chamber 52*a* is equal to the distance DPb between the ink supply port 560 and the ink circulation port 570 which are connected to a second pressure chamber 52*b*. This relationship is established with respect to all the pressure chambers 52 in the liquid ejection head 50. In other words, in respect of all of the pressure chambers 52, the distances each of which follows the flow direction of the liquid in the common flow channel 55 between an ink supply port 560 and an ink circulation port 570 which are opened in the common flow channel 55 and which connect to the same pressure chamber 52, are the same distance. Here, the magnitude of the distance between the ink supply port 560 and the ink circulation port 570 corresponds to the magnitude of the pressure differential in the liquid between the ink supply port 560 and the ink circulation port 570. In the present embodiment, the ink supply ports 560 and the ink circulation ports 570 which are opened in the common flow channel 55 are arranged at positions so that the pressure differential in the ink between the ink supply port 560 and the ink circulation port 570 which are connected to the same pressure chamber 52 is equal, at all of the pressure chambers 52. Therefore, the flow rates of the ink flowing in all the pressure chambers 52 are equal to each other.

A case is described above where the cross-sectional area of the common flow channel 55 is the same for all of the pressure chambers 52, but the present invention is not limited in particular to a case of this kind, and it may also be applied to a case where the cross-sectional area of the common flow channel 55 is not the same for all of the pressure chambers. In a case where the cross-sectional area is not the same in this fashion, the ink supply ports 560 and the ink circulation ports 570 are arranged at positions so that the pressure differential in the ink between the ink supply port 560 and the ink circulation port 570 which are connected to the same pressure chamber 52 is equal, for all of the pressure chambers 52.

Figure 2:
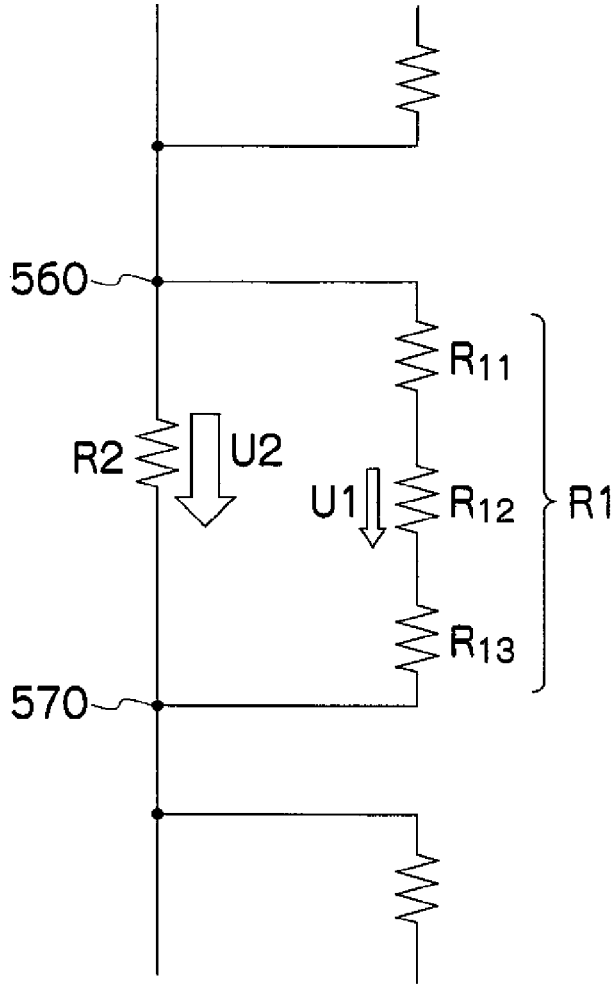
FIG. 2 is a diagram showing an equivalent model which is equivalent to the principal part of the liquid ejection head in FIG. 1.

FIG. 2 is a commonly known acoustic circuit model which is equivalent to the principal part of the liquid ejection head 50 shown in FIG. 1 (hereinafter, this mode is also called an "equivalent model"). In FIG. 2, only one pressure chamber 52 and a portion of the common flow channel 55 corresponding to that pressure chamber 52 are depicted. The amount of ink flowing in a pressure chamber 52 is described below, with reference to this equivalent model.

In FIG. 2, R1 is the flow channel resistance on the pressure chamber 52 side (namely, the flow channel resistance from the ink supply port 560, via the pressure chamber 52, and up to the ink circulation port 570), which is sum of the flow channel resistance $R_{11}$ of one ink supply flow channel 56, the flow channel resistance $R_{12}$ of one pressure chamber 52, and the flow channel resistance $R_{13}$ of one ink circulation flow channel 57. R2 is the flow channel resistance of a portion of the common flow channel 55 corresponding to one pressure chamber 52 (in other words, the flow channel resistance from the ink supply port 560 which is connected to the pressure chamber 52, via the common flow channel 55, and up to the ink circulation port 570).

The equivalent model is constituted by connecting parallel circuits each comprising the flow channel resistance R1 and the flow channel resistance R2, in series. In an equivalent model of this kind, it can be seen that if a pressure is applied to both ends of the flow channel resistance R2 (in other words, if a pressure is applied to the common flow channel 55 in such a manner that ink flows through the common flow channel 55), then this means that the same pressure is applied to both ends of the flow channel resistance R1, and therefore ink also flows through the pressure chamber 52 which corresponds to the flow channel resistance R1. In other words, ink is supplied from the common flow channel 55 to the pressure chamber 52 via the ink supply flow channel 56, and the ink is returned to the common flow channel 55 via the ink circulation flow channel 57.

The ratio U1:U2 between the volume of liquid flowing through the common flow channel 55, U1, and the volume of liquid flowing through the pressure chamber 52, U2, is equal to the ratio R2:R1 between the flow channel resistances.

The following Formulas 1 to 4 are used to calculate the flow channel resistances R1 and R2.

Figure 3:
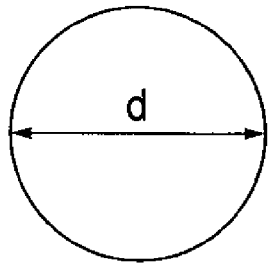
FIG. 3 is a cross-sectional diagram of a circular tube.

In the case of a round tube which has a circular cross-sectional shape as shown in FIG. 3, the flow channel resistance R is expressed by Formula 1.

$$R = \frac{128\mu l}{\pi d^4} \qquad \text{Formula 1}$$

Here, "μ" is the viscosity of the ink, "d" is the diameter of the flow channel and "l" is the length of the flow channel.

In the case of a flow channel in which the diameter d changes in the lengthwise direction (the x-axis direction), then the flow channel resistance R is expressed by Formula 2.

$$R = \int \frac{128\mu}{\pi\{d(x)\}^4} dx \qquad \text{Formula 2}$$

Figure 4:
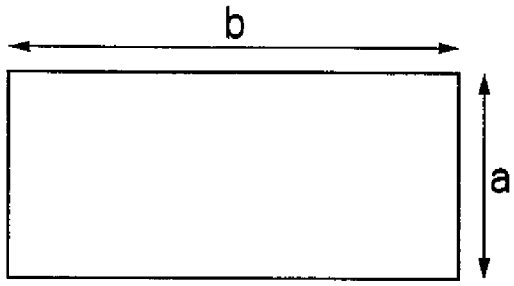
FIG. 4 is a cross-sectional diagram of a flow channel having a rectangular shaped cross-section.

In the case of a rectangular tube which has a rectangular cross-sectional shape as shown in FIG. 4, the flow channel resistance R is expressed by Formula 3.

$$R = 2k\mu l \frac{S^2}{A^3} \qquad \text{Formula 3}$$

Here, "μi" is the viscosity of ink, "l" is the length of the flow channel, "A" is the cross-sectional area of the flow channel, and "S" is the total circumference of the flow channel. Furthermore, "k" is a constant which is determined by the aspect ratio ϵ, as expressed by Formula 4.

$$k = \frac{1.5}{(1+\varepsilon)^2\left\{1 - \frac{192}{\pi^5}\varepsilon\left(\tanh\frac{\pi}{2\varepsilon} + \frac{1}{3^5}\tanh\frac{\pi}{2\varepsilon} + \dots\right)\right\}} \qquad \text{Formula 4}$$

Here, the aspect ratio ϵ satisfies the following: ϵ=a/b (where b>a). In other words, it is the ratio of the lengths "a" and "b" of the two edges of the rectangular shape shown in FIG. 4.

Here, it is considered that the actual design value of the pressure differential applied between the ink supply port 560 and the ink circulation port 570 connected to the same pressure chamber 52 is 5 Pa. If the pressure differential is equal to or greater than this value, then variation arises in the volume of the ink droplets ejected from the pressure chambers 52 and non-uniformities may occur in the image formed on an ejection receiving medium. Furthermore, it is considered that the actual design values are R1=$1\times10^{13}$ (Ns/m$^5$) and R2=$1\times10^{9}$ (Ns/m$^5$). These values of R1 and R2 are selected appropriately when the liquid ejection head 50 is manufactured. In the liquid ejection head 50 shown in FIG. 1, if the pressure differential is 5 Pa and the flow channel resistances are R1 and R2, then the volume U1 of ink flowing through the pressure chamber 52 will be 500 pl/s and the volume U2 of ink flowing through the common flow channel 55 will be $5\times10^6$ pl/s.

Firstly, considering the value of U1, if the flow rate inside the pressure chamber 52 is approximately 500 pl/s, then it is possible to achieve a satisfactory effect in preventing increase in the viscosity of the ink. Next, the value of the U2 is considered below. In other words, the refilling characteristics is considered below. The volumetric ejection speed for one nozzle at full duty is $4\times10^5$ pl/s per nozzle, for example. This is the figure in the case of an ejection frequency of 20 kHz and a liquid droplet volume of 2 pl. The volume of ink which flows in the common flow channel 55, U2 (=$5\times10^6$ pl/s), is one power of ten greater than volumetric ejection speed per nozzle, which is $4\times10^5$ pl/s, and is therefore substantially equal to the ink ejection volume of approximately ten nozzles 51 operating at full duty. In other words, even in the case of a liquid ejection head 50 in which ten nozzles 51 are arranged with respect to one common flow channel 55, the volume of ink lost due to ejection from the nozzles 51 can be supplied (refilled) without giving rise to any delay. Even if nozzles 51 of a greater number than ten are provided with respect to one common flow channel 55, the effects in assisting the refilling of ink into the pressure chambers 52 are extremely beneficial.

As described above, according to the structure shown in FIG. 1, it is possible to simultaneously obtain both an effect in preventing increase in the viscosity of the ink in the nozzles 51 and the pressure chambers 52, and an effect in assisting the refilling of ink into the pressure chambers 52.

The positional relationship between the pressure chambers 52, the ink supply flow channels 56 and the ink circulation flow channels 57 is not limited in particular to the positional relationship shown in the basic schematic drawing in FIG. 1.

Below, the liquid ejection head 50 shown in FIG. 1 will be described in detail, separately with reference to embodiments which respectively have different positional relationships among the pressure chambers 52, the ink supply flow channels 56, the ink circulation flow channels 57, and the like.

First Embodiment

Figure 5:
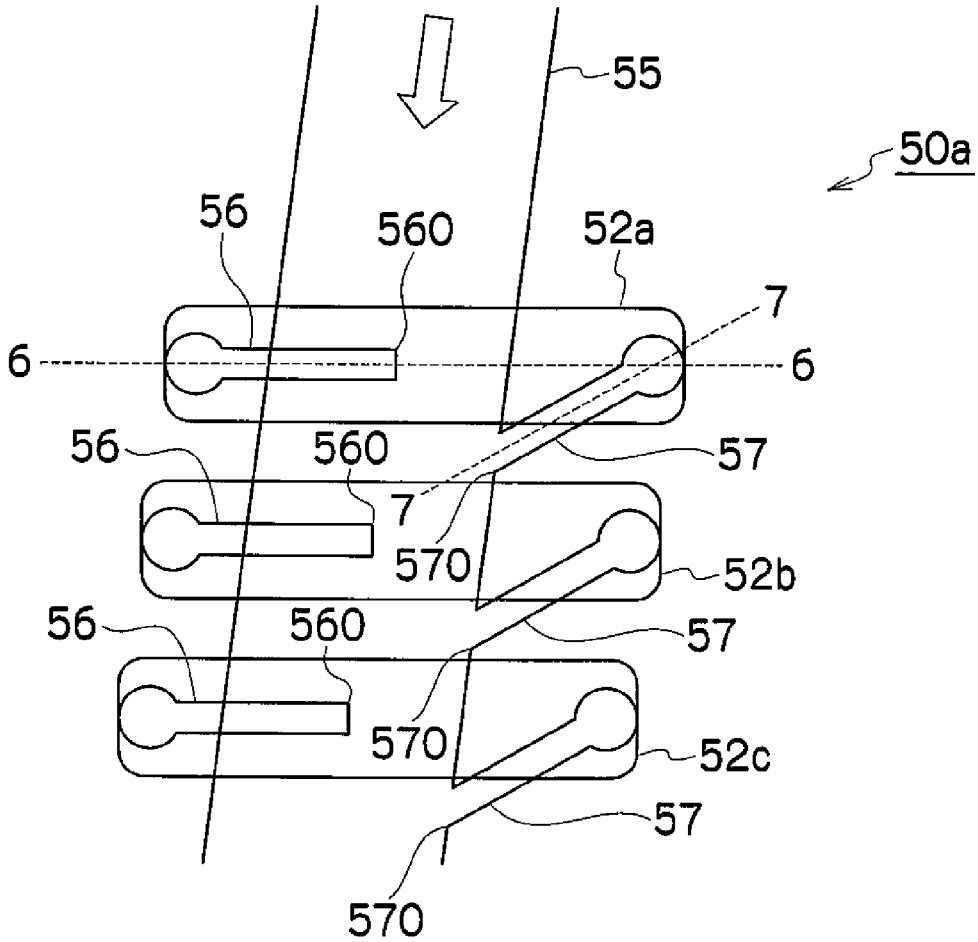
FIG. 5 is a plan view perspective diagram showing the principal part of a liquid ejection head which is one example of a first embodiment of the present invention.

FIG. 5 is a planar perspective diagram showing the principal part of a liquid ejection head 50*a* which is one example of a first embodiment. Furthermore, FIG. 6 shows a cross-sectional view along line 6-6 of the liquid ejection head 50*a* shown in FIG. 5; and FIG. 7 shows a cross-sectional view along line 7-7 of the liquid ejection head 50*a* shown in FIG. 5.

Figure 6:
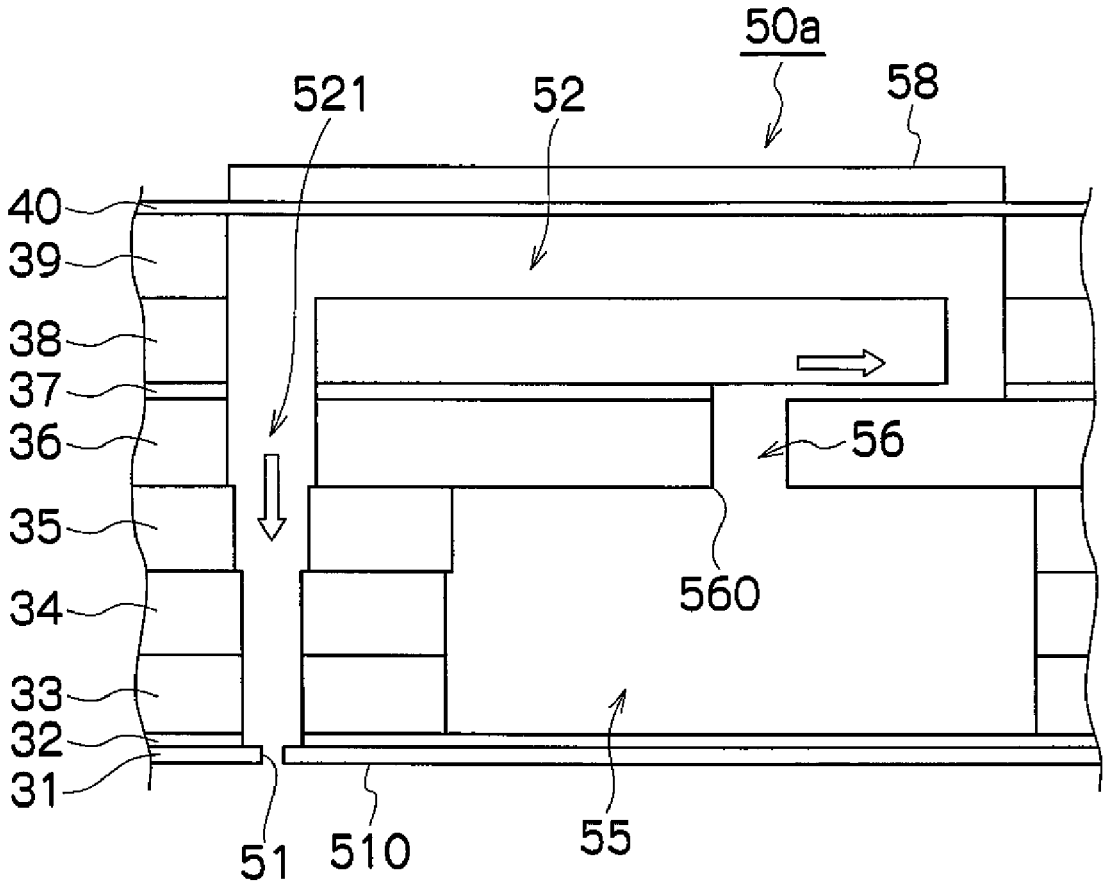
FIG. 6 is a vertical cross-sectional diagram along line 6-6 in FIG. 5.
Figure 7:
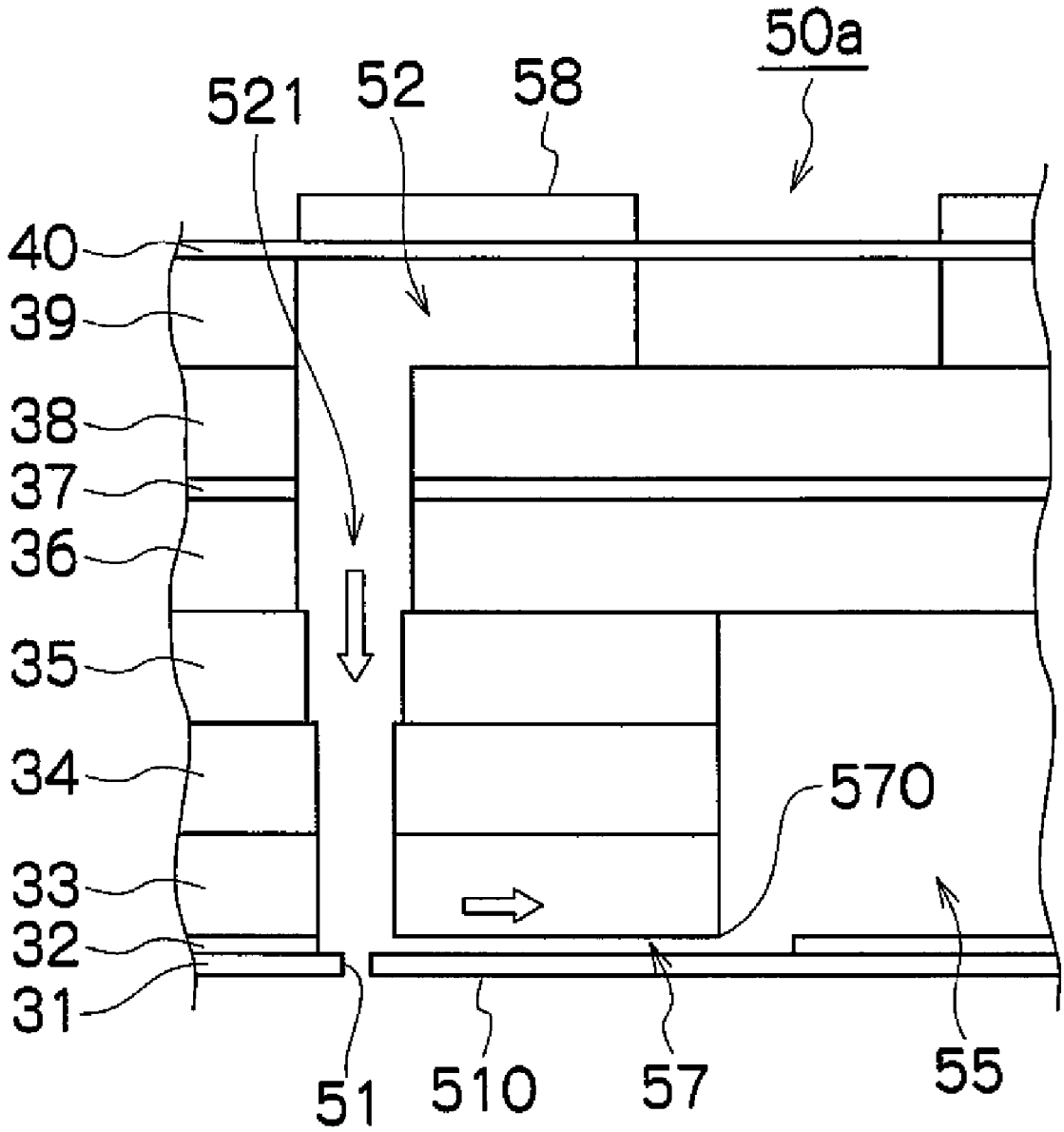
FIG. 7 is a vertical cross-sectional diagram along line 7-7 in FIG. 5.

As shown in FIG. 6 and FIG. 7, the liquid ejection head 50*a* is constituted by sequentially layering together a plurality of plates 31, 32, 33, 34, 35, 36, 37, 38, 39 and 40, from the lower side to the upper side in terms of the vertical direction.

A nozzle 51 is formed in the first plate 31 (nozzle plate) which forms the bottommost layer in the vertical direction. An ink circulation flow channel 57 is formed in the second plate 32 (the circulation flow channel plate). A common flow channel 55 is formed in the third plate 33, the fourth plate 34 and the fifth plate 35. An ink supply flow channel 56 is formed in the sixth plate 36, the seventh plate 37 and the eighth plate 38. A pressure chamber 52 is formed in the ninth plate 39. The tenth plate 40 is a diaphragm, which forms the ceiling plate of the pressure chamber 52. A piezoelectric element 58 is formed on top of the diaphragm 40 to serve as an actuator which changes the volume of the pressure chamber 52 so as to cause ink to be ejected from the nozzle 51.

Furthermore, in the third to eighth plates 33 to 38, a nozzle connection flow channel 521 is formed to extend from the pressure chamber 52 until the vicinity of the nozzle 51. This nozzle connection flow channel 521 can be regarded as a portion of the pressure chamber 52 in the present embodiment. In other words, in the present embodiment, the ink circulation flow channel 57 is connected to the pressure chamber 52. The flow channel resistance R12 of the pressure chamber 52 in the equivalent model in FIG. 2 includes the flow channel resistance of this nozzle connection flow channel 521. FIG. 6 and FIG. 7 show an example where the nozzle connection flow channel 521 is appended to the pressure chamber 52, but the present embodiment is not limited in particular to a case such as this, and it may also include cases where there is no nozzle connection flow channel 521 and the nozzle 51 is connected directly to the pressure chamber 52.

It is desirable that the positions of the connections between the ink circulation flow channels 57 and the common flow channels 55 should be in the lower portions of the common flow channels 55 in terms of the vertical direction, as shown in FIG. 7. If an ink circulation flow channel 57 is connected to a common flow channel 55 at a position to the lower side of the common flow channel 55 in terms of the vertical direction in this way, then gas bubbles inside the common flow channel 55 are not liable to enter from the ink circulation flow channel 57 into the nozzle 51 or the pressure chamber 52, and therefore ejection abnormalities caused by such gas bubbles are prevented.

FIG. 7 shows an example of a most desirable case where an ink circulation flow channel 57 is connected to the bottom-most position of a common flow channel 55, but the composition is not limited in particular to a case of this kind. The present embodiment also includes any case where the ink circulation flow channel 57 is connected at a position lower than ½ of the height of the common flow channel 55 in terms of the vertical direction.

Furthermore, as shown in FIG. 7, it is desirable that the ink circulation flow channel 57 should be connected to the pressure chamber 52 (in the present embodiment, to the nozzle connection flow channel 521) in the vicinity of the nozzle 51. In other words, a structure is achieved in which the ink is caused to circulate from the vicinity of the nozzle 51 into the common flow channel 55. By adopting a structure of this kind, a beneficial effect is obtained in that ink of increased viscosity can be circulated with better efficiency.

FIG. 6 shows a case where the ink supply flow channel 56 is connected to substantially the center of the ceiling of the common flow channel 55, but the present embodiment is not limited in particular to a case of this kind.

Figure 8:
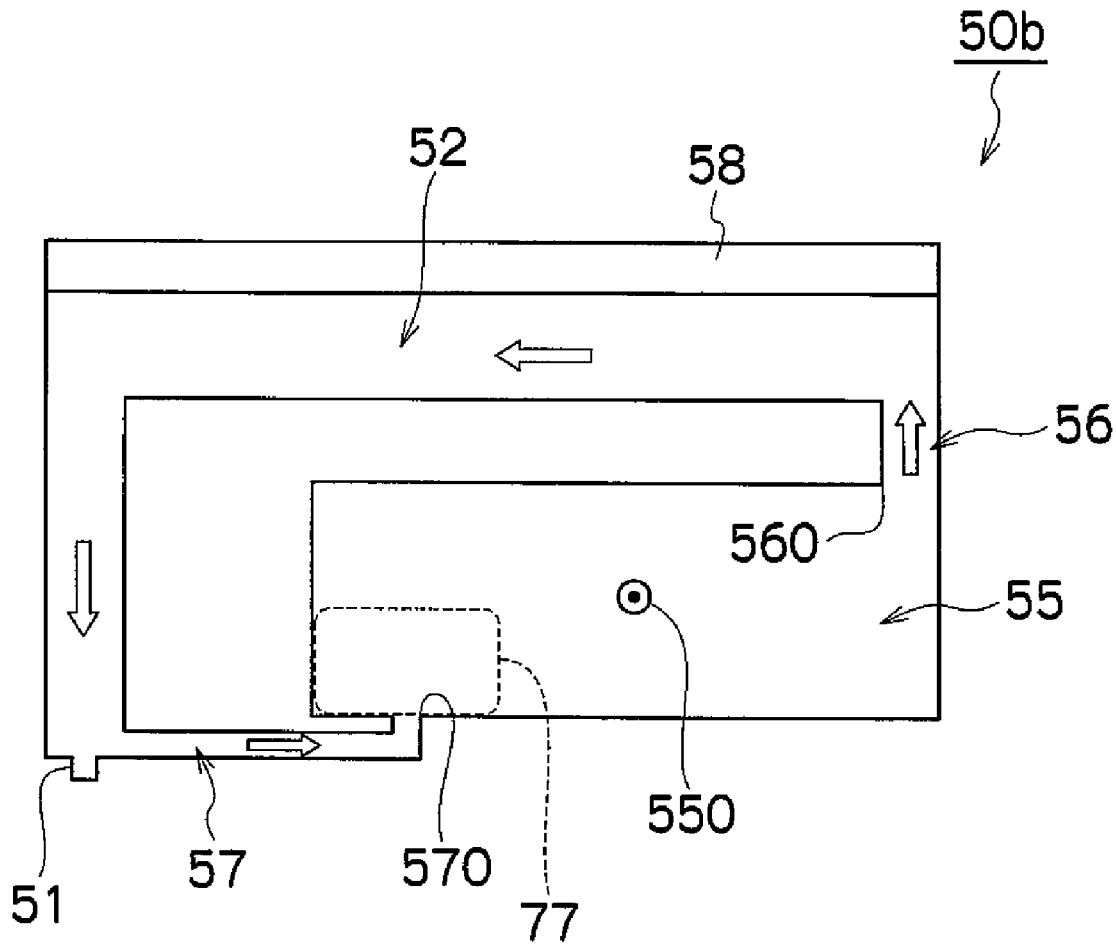
FIG. 8 is a vertical cross-sectional perspective diagram showing the principal part of a liquid ejection head which is a further example of the first embodiment.

FIG. 8 shows in particular an ink supply port 560 and an ink circulation port 570 which are connected to the same pressure chamber 52 in a liquid ejection head 50*b* according to a further example of the present embodiment, and it depicts a cross-sectional perspective view in which a section that is perpendicular to the direction of flow of the liquid in the common flow channel 55 is observed from the upstream side toward the downstream side.

In FIG. 8, the ink supply port 560 and the ink circulation port 570 which are connected to the same pressure chamber 52 are disposed in substantially diagonally opposite positions, with reference to the axial line 550 which passes in the direction of flow of the liquid in the common flow channel 55.

The ink which exits from the pressure chamber 52 and passes in the vicinity of the nozzle 51 increases slightly in viscosity. In other words, the ink 77 which returns to the common flow channel 55 from the ink circulation flow channel 57 is in a state of increased viscosity. If this ink 77 of increased viscosity were to enter back into the pressure chamber 52 via the ink supply flow channel 56 and pass again in the vicinity of the nozzle 51, then the viscosity of the ink would rise yet further. Therefore, as shown in FIG. 8, the ink supply port 560 (in other words, the position of the connection between the ink supply flow channel 56 and the common flow channel 55) and the ink circulation port 570 (in other words, the position of the connection between the ink circulation flow channel 57 and the common flow channel 55) are disposed in substantially diagonally opposite positions in the common flow channel 55, in order that the ink 77 of increased viscosity does not enter back into the pressure chamber 52. In this way, the ink supply port 560 and the ink circulation port 570 are connected with the common flow channel 55 in mutually opposing (diagonally opposite) positions.

Since the ink flows inside the common flow channel 55 in a laminar flow, then the ink 77 of increased viscosity which exits from the ink circulation flow channel 57 and is circulated into the common flow channel 55, and the fresh ink which enters into the common flow channel 55 from the ink supply flow channel 56 do not mix together.

Second Embodiment

Figure 9:
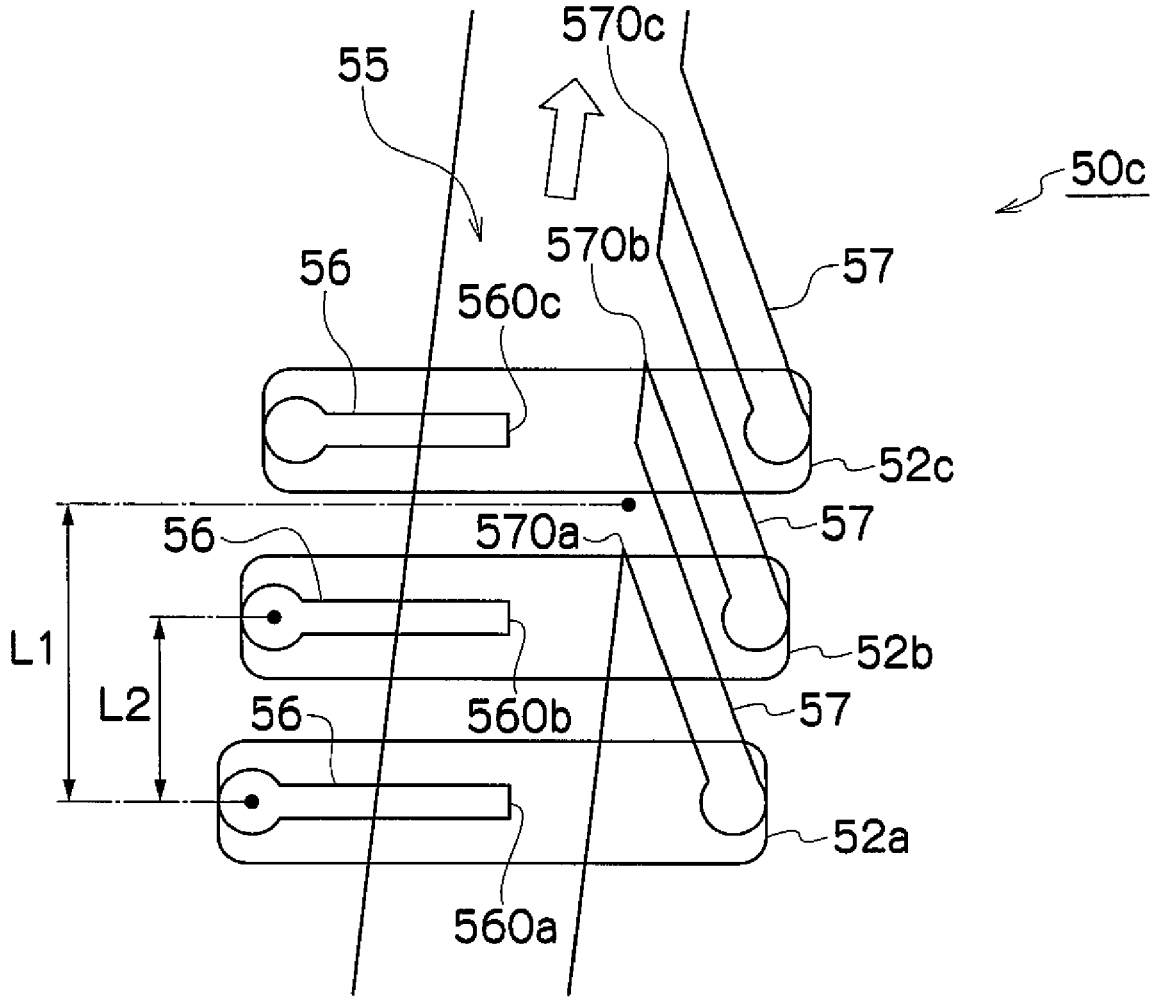
FIG. 9 is a plan view perspective diagram showing the principal part of a liquid ejection head which is one example of a second embodiment of the invention.

FIG. 9 is a planar perspective diagram showing the principal part of a liquid ejection head 50*c* which is one example of a second embodiment. In FIG. 9, the same reference numerals are assigned to constituent elements which are the same as the constituent elements of the liquid ejection head 50*a* of the example of the first embodiment which is shown in FIG. 5, and details which have already been described with reference to the first embodiment are not explained further here.

In FIG. 9, the common flow channel 55 is disposed following the direction of arrangement of a plurality of pressure chambers 52 (e.g. 52*a*, 52*b*, 52*c*). In other words, a plurality of pressure chambers 52 are arranged following the direction of the flow of liquid in the common flow channel 55. In order to simplify the illustration, FIG. 9 shows only three pressure chambers 52, in other words, the $i^{th}$ pressure chamber 52*a*, the $(i+1)^{th}$ pressure chamber 52*b*, and the $(i+2)^{th}$ pressure chamber 52*c*, but the number of pressure chambers 52 is not limited in particular to three, and N pressure chambers 52 (where N is an integer equal to or greater than 2) are arranged following the direction of flow of the liquid in the common flow channel 55.

In FIG. 9, any two pressure chambers 52 which are mutually adjacent, of the N pressure chambers 52, are observed in particular. For example, the $i^{th}$ pressure chamber 52*a* and the $(i+1)^{th}$ pressure chamber 52*b*, which are referred to below as the "first pressure chamber" 52*a* and the "second pressure chamber" 52*b*, are observed in particular. Here, the ink supply port 560*b* (second ink supply port) which is connected to the second pressure chamber 52*b* is disposed to the downstream side in terms of the direction of flow of liquid in the common flow channel 55, in comparison with the ink supply port 560*a* (first ink supply port) which is connected to the first pressure chamber 52*a*. Similarly, the ink circulation port 570*b* (second ink circulation port) which is connected to the second pressure chamber 52*b* is disposed to the downstream side in terms of the direction of flow of liquid in the common flow channel 55, in comparison with the ink circulation port 570*a* (first ink circulation port) which is connected to the first pressure chamber 52*a*. The positional relationship described above is the same as that of the liquid ejection head 50*a* according to the first embodiment; however, in the liquid ejection head 50*c* according to the present embodiment, in contrast to the liquid ejection head 50*a* according to the first embodiment, the ink circulation port 570*a* (first ink circulation port) which is connected to the first pressure chamber 52*a* is disposed to the downstream side in terms of the direction of flow of liquid in the common flow channel 55, in comparison with the ink supply port 560*b* (second ink supply port) which is connected to the second pressure chamber 52*b*. In other words, taking the distance between the ink supply port 560 and the ink circulation port 570 which are connected to the same pressure chamber 52 (for example, pressure chamber 52*a*) to be L1, and taking the distance between two ink supply ports 560 which are connected respectively to different pressure chambers 52 that are mutually adjacent in the direction of flow of liquid in the common flow channel 55 (for example, pressure chambers 52*a* and 52*b*), to be L2, then L1>L2. This positional relationship is established for all of the pressure chambers 52 which are arranged following the direction of flow of liquid in the common flow channel 55.

Here, the pressure differential (also called "back pressure differential") between pressure chambers 52 will be described. From the viewpoint of preventing increase in the viscosity of the ink inside the pressure chambers 52, the pressure differential applied to the common flow channel 55 should be made large, thereby raising the ink flow rate. However, in so doing, the pressure differential between the pressure chambers 52 which are aligned with the common flow channel 55 also becomes large. If the pressure differential between the pressure chambers 52 is large, then variation in the ink ejection volume occurs between the nozzles 51, and this a cause of non-uniformities in the image. By adopting the liquid ejection head 50 according to the present embodiment, the pressure differential between the ink supply port 560 and the ink circulation port 570 which are connected to the same pressure chamber 52 (this pressure differential corresponds to L1) is large, while the pressure differential between ink supply ports 560 which are connected respectively to mutually adjacent pressure chambers 52 (this pressure differential corresponds to L2) is small. In other words, "L1>L2" is satisfied, and therefore it is possible to achieve a small pressure differential between the pressure chambers 52 while maintaining a large ink flow volume inside the pressure chambers 52.

The positions of the ink circulation ports 570 are not limited in particular to the positions shown in FIG. 9, and they may be any positions where "L1>L2" is satisfied.

Third Embodiment

Figure 10:
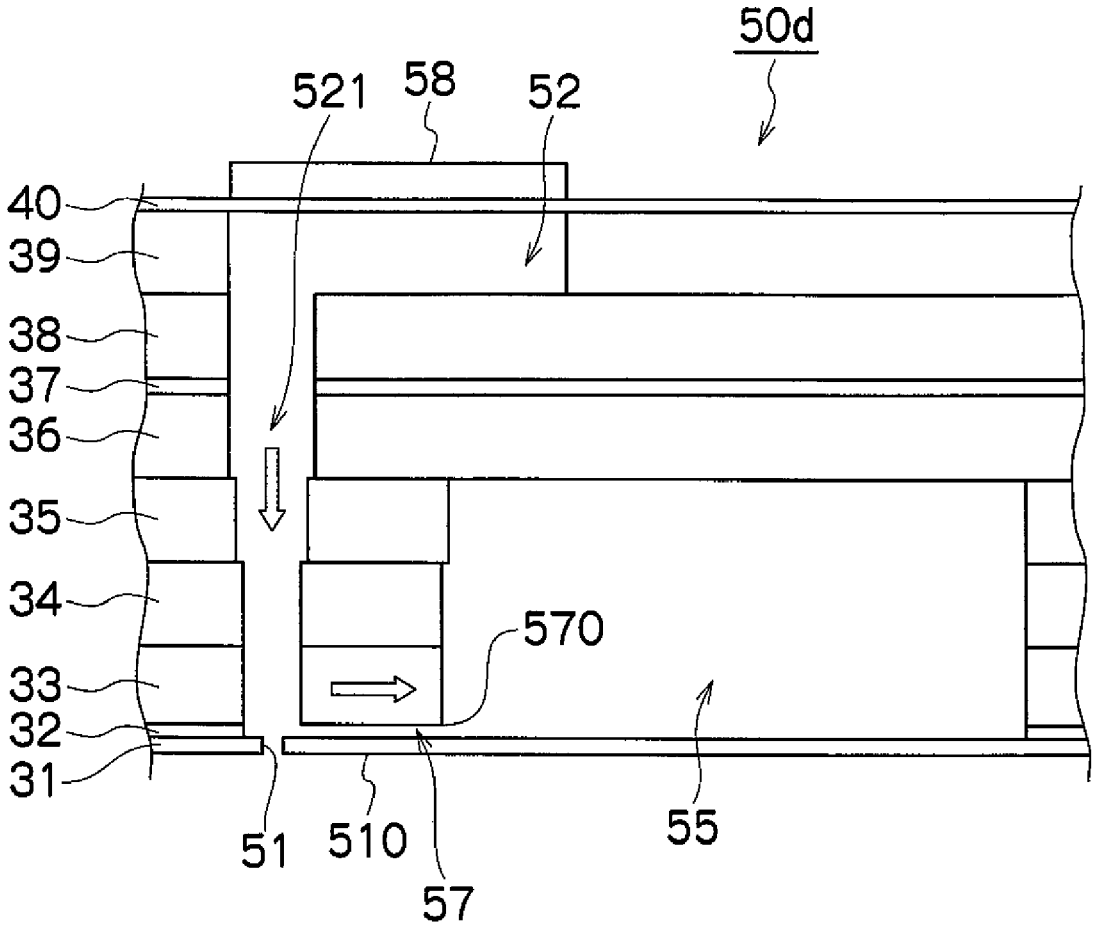
FIG. 10 is a plan view perspective diagram showing the principal part of a liquid ejection head which is one example of a third embodiment.

FIG. 10 is a cross-sectional diagram showing the principal part of a liquid ejection head 50*d* which is one example of a third embodiment. FIG. 10 is a cross-sectional diagram viewed in a vertical direction perpendicular to the nozzle surface 510. In FIG. 10, the same reference numerals are assigned to constituent elements which are the same as the constituent elements of the liquid ejection head 50*a* of the first embodiment which is shown in FIG. 7, and details which have already been described with reference to the first embodiment are not explained further here.

In FIG. 10, the liquid ejection head 50*d* is constituted by sequentially layering together a plurality of plates 31 to 40, including a nozzle plate 31 which is formed with a nozzle 51, and a circulation flow channel plate 32 which is formed with an ink circulation flow channel 57.

Here, the circulation flow channel plate 32 is adjacent to the nozzle plate 31. In other words, of the plurality of plates 32, 33, 34 and 35 which constitute the common flow channel 55, the ink circulation flow channel 57 is formed in the plate 32 which is nearest to the nozzle surface 510. Furthermore, in the present embodiment, the common flow channel 55 is formed in contact with the nozzle plate 31. In other words, the bottom face of the common flow channel 55 is constituted by the nozzle plate 31. By this means, the thickness of the separation between the common flow channel 55 and the exterior is only the thickness of the nozzle plate 31, and therefore the common flow channel 55 has a damping function of absorbing cross talk between pressure chambers 52.

By adopting a composition of this kind, it is possible to circulate the ink from the vicinity of the nozzle to the common flow channel, in such a manner that the effect in preventing increase in the viscosity of ink can be maximized while a damping capacity of the common flow channel 55 with respect to cross-talk between the pressure chambers 52 is obtained.

Fourth Embodiment

Figure 11:
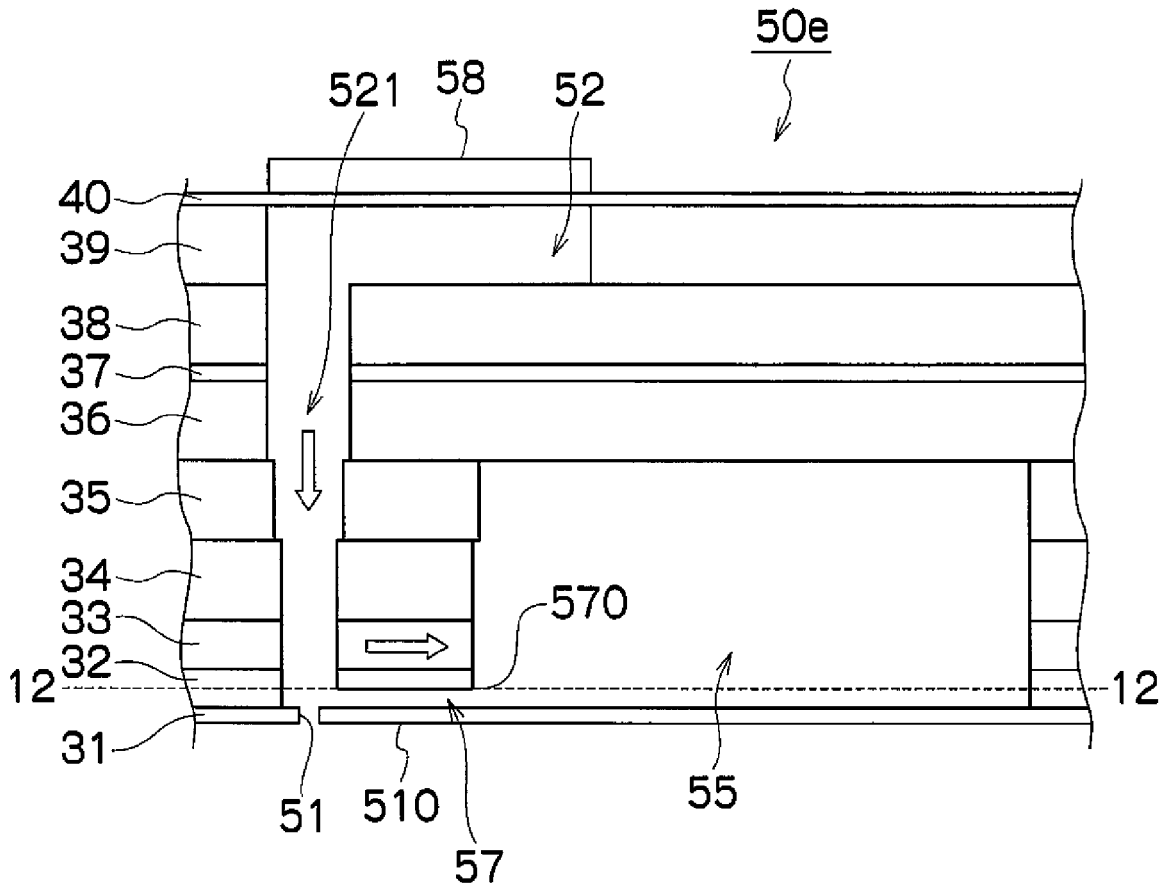
FIG. 11 is a plan view perspective diagram showing the principal part of a liquid ejection head which is one example of a fourth embodiment.
Figure 12:
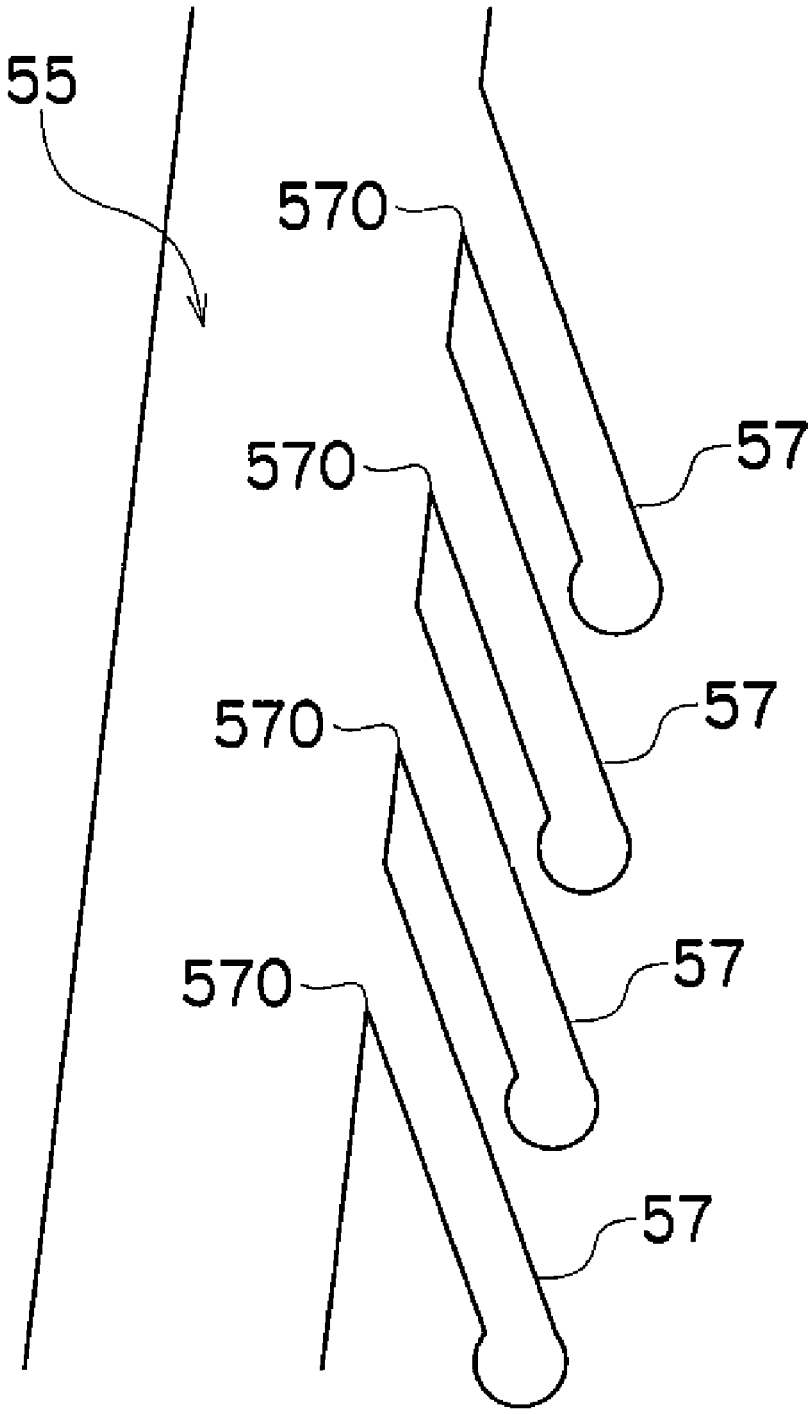
FIG. 12 is a horizontal cross-sectional diagram along line 12-12 in FIG. 11.

FIG. 11 is a cross-sectional diagram showing the principal part of a liquid ejection head 50*e* which is one example of a fourth embodiment. FIG. 11 is a cross-sectional diagram viewed in a vertical direction perpendicular to the nozzle surface 510. In FIG. 11, the same reference numerals are assigned to constituent elements which are the same as the constituent elements of the liquid ejection head 50*d* of the third embodiment which is shown in FIG. 10, and details which have already been described are not explained further here. Furthermore, FIG. 12 shows a horizontal cross-sectional diagram along line 12-12 in FIG. 11.

In FIG. 11, the ink circulation flow channels 57 are groove sections which are formed by half-etching the circulation flow channel plate 32 in the thickness direction. In other words, the height of the ink circulation flow channel 57 is smaller than the thickness of the circulation flow channel plate 32.

By adopting a composition of this kind, it is possible to improve the rigidity of the circulation flow channel plate 32 in which the ink circulation flow channels 57 are formed, and therefore handling becomes easier. Furthermore, since the flow channel resistance of the ink circulation flow channels 57 is increased, then it is also possible to increase the ejection efficiency.

Furthermore, as shown in FIG. 1, the groove sections forming the ink circulation flow channels 57 which are created by half etching are desirably formed in the thickness direction of the circulation flow channel plate 32, on the side adjacent to the nozzle plate 31. This is because circulating the ink from the vicinity of the nozzle 51 to the common flow channel 55 increases the effect of preventing increase in the viscosity.

Fifth Embodiment

Figure 13:
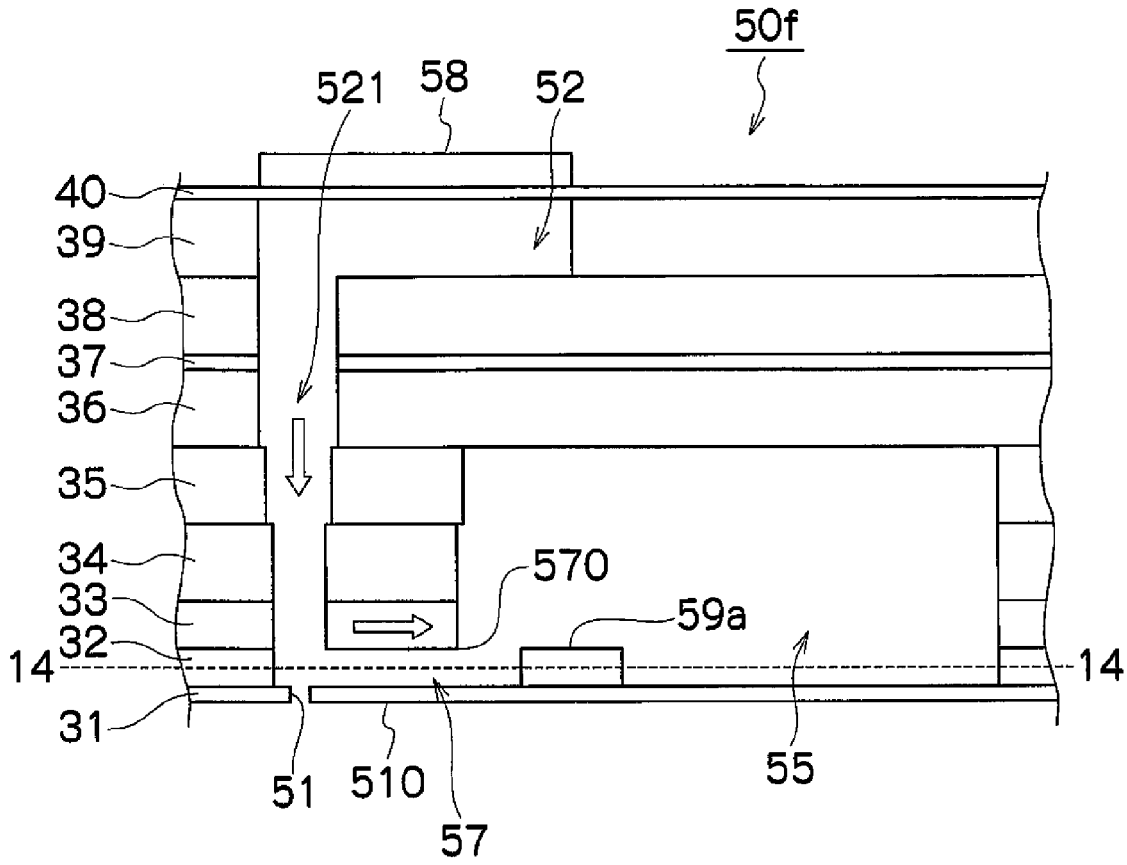
FIG. 13 is a plan view perspective diagram showing the principal part of a liquid ejection head which is one example of a fifth embodiment.

FIG. 13 is a cross-sectional diagram showing the principal part of a liquid ejection head 50*f* which is one example of a fifth embodiment. FIG. 13 is a cross-sectional diagram viewed in a vertical direction perpendicular to the nozzle surface 510. In FIG. 13, the same reference numerals are assigned to constituent elements which are the same as the constituent elements of the liquid ejection head 50*d* of the third embodiment which is shown in FIG. 10, and details which have already been described are not explained further here. Furthermore, FIG. 14 shows a horizontal cross-sectional diagram along line 14-14 in FIG. 13.

Figure 14:
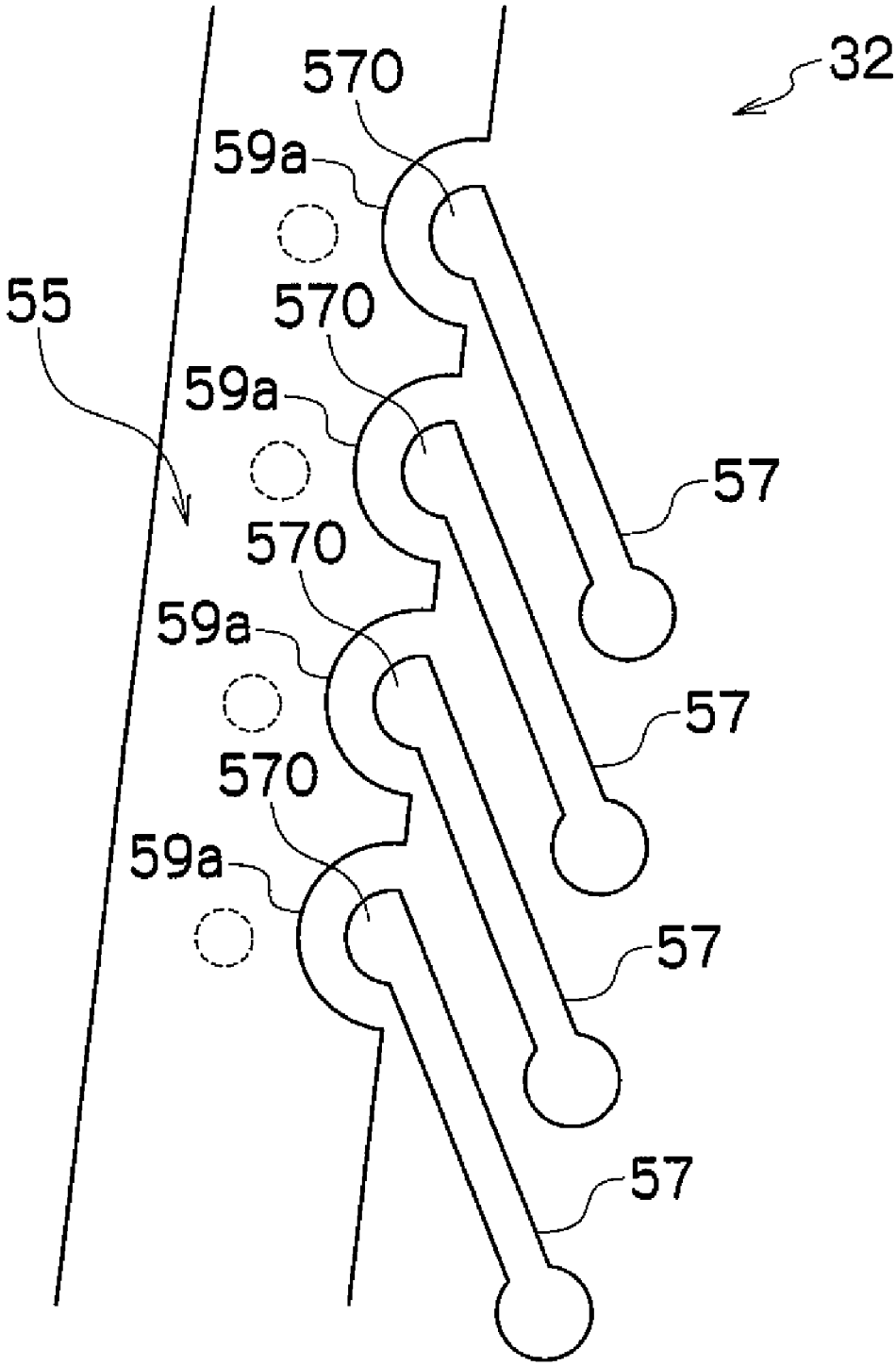
FIG. 14 is a horizontal cross-sectional diagram along line 14-14 in FIG. 13.

In FIG. 13 and FIG. 14, projection-shaped bridge sections 59*a* are disposed in the common flow channel 55 so as to form rigid bodies which surround the ink circulation ports 570. The height of each bridge section 59*a* is the same as the thickness of the circulation flow channel plate 32. If the ink circulation flow channels 57 are formed by etching in the circulation flow channel plate 32, then the bridge sections 59*a* forming rigid bodies are created by leaving the perimeter of each of the ink circulation ports 570 without being etched. They may also be created by half-etching.

Rigidity is obtained in the circulation flow channel plate 32 by means of the bridge sections 59*a* of this kind. Furthermore, if the ink circulation flow channels 57 are formed by half etching as in the liquid ejection head 50*e* according to the fourth embodiment which is shown in FIG. 11, then it is difficult to achieve good dimensional accuracy of the ink circulation flow channels 57 (in terms of the height in the thickness direction of the plate), whereas in the present embodiment, it is not necessary to form the ink circulation flow channels 57 by half etching, and the height of the ink circulation flow channels 57 is governed by the thickness of the circulation flow channel plate 32, and therefore the dimensional accuracy of the ink circulation flow channels 57 can be ensured readily.

Figure 15:
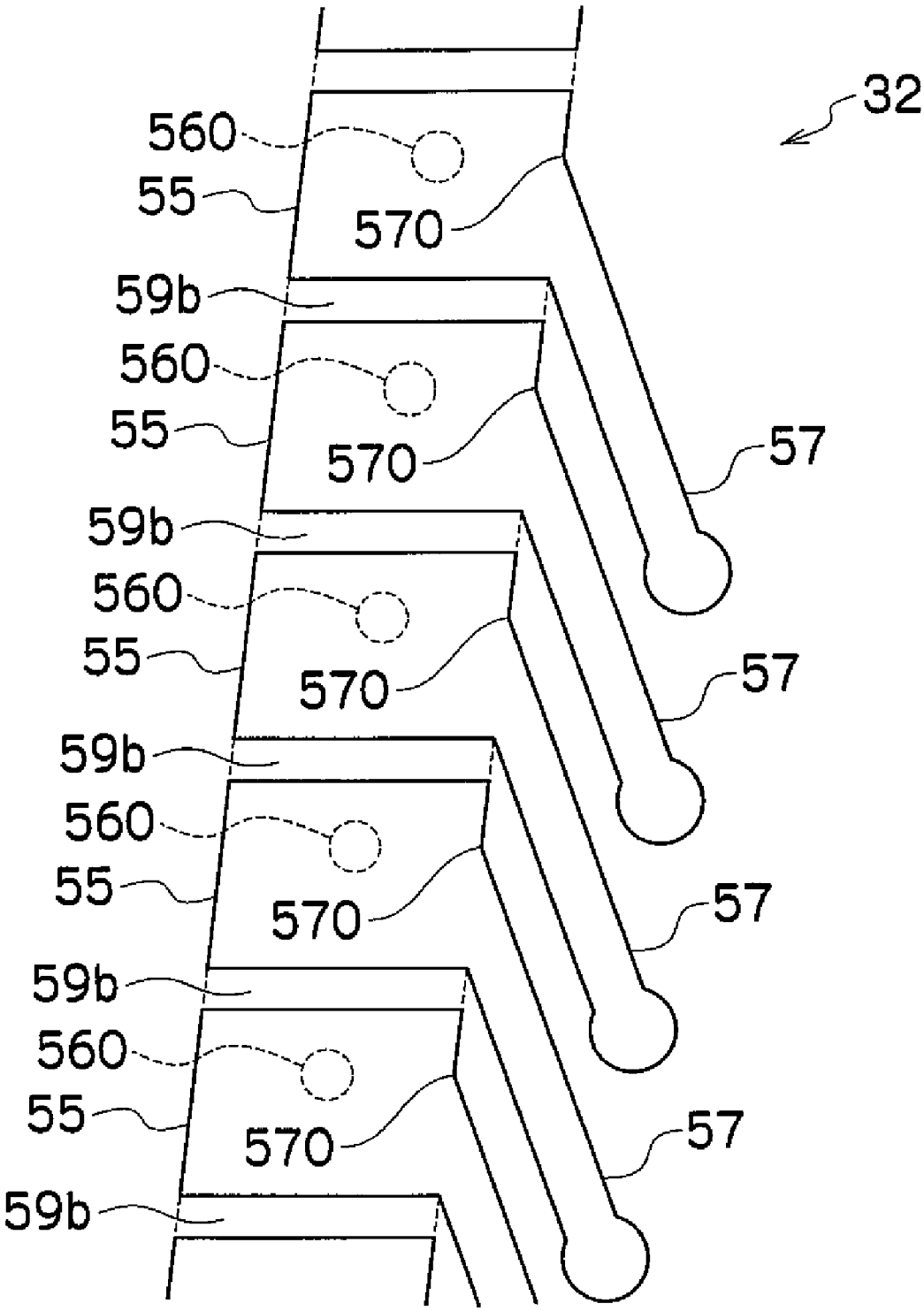
FIG. 15 is a horizontal cross-sectional diagram used to describe a further example of rigid bodies.

The rigid bodies are not limited in particular to the bridge sections 59*a* as shown in FIG. 14. For example, as shown in the horizontal cross-sectional view shown in FIG. 15, looking at the whole of the circulation flow channel plate 32, it is also possible to form the spaces each of which surrounds each of the ink circulation flow channels 57 in the common flow channel 55. More specifically, the bridge sections 59*b* (rigid bodies) are formed in another plate separate from the circulation flow channel plate 32, and are provided in between each pair of ink supply ports 560 which are mutually adjacent in the common flow channel 55. In this way, by arranging the bridge sections 59*b* and the ink supply ports 560 at positions which are not mutually overlapping (and by arranging the bridge sections 59*b* so as not to locate between pairs of the ink supply ports 560 and the ink circulation flow channels 57), inside the common flow channel 55, then cross-talk waves exiting from the ink supply ports 560 are prevented from striking the bridge sections 59*b* directly. In the present example, the bridge sections 59*b* are each provided exactly midway between two ink supply ports 560, and therefore the damping effect of the common flow channel 55 with respect to cross talk between the pressure chambers 52 is improved.

In the present example, the bridge sections 59*b* having the same length as the width of the common flow channel 55 are provided as rigid bodies, in the breadthways direction of the common flow channel 55, but the composition is not limited in particular to a case such as this, and it is also possible to provide the bridge sections 59*b* forming rigid bodies in an oblique direction with respect to the breadthways direction of the common flow channel 55.

Image Forming Apparatus

Figure 16:
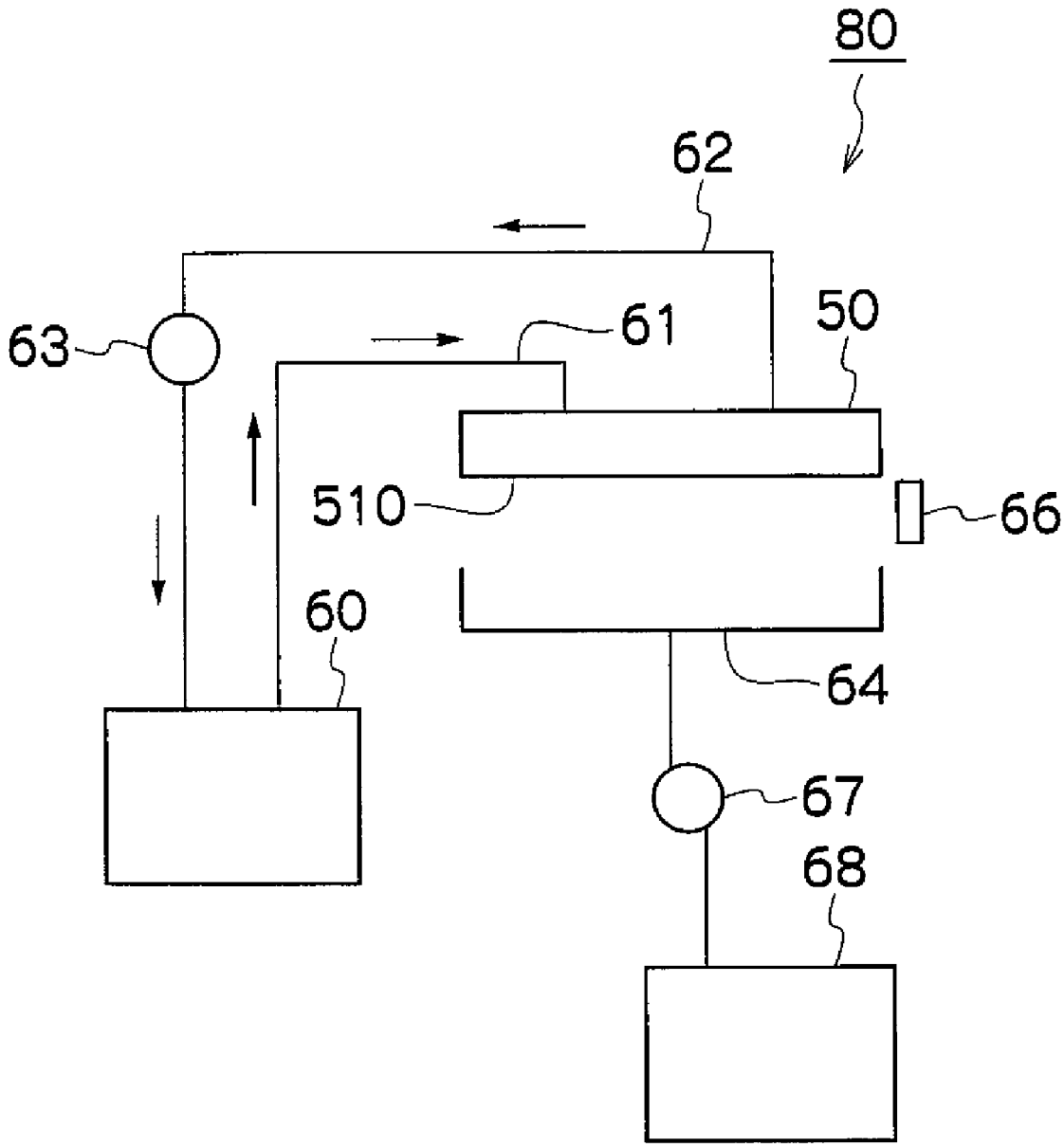
FIG. 16 is a schematic drawing showing the composition of a liquid supply system and a maintenance system of an image forming apparatus which is one example of a liquid ejection apparatus.

FIG. 16 is a schematic drawing showing the composition of a liquid supply system and a maintenance system of an image forming apparatus 80 comprising a liquid ejection head 50 according to an embodiment of the present invention.

In FIG. 16, the image forming apparatus 80 comprises a liquid ejection head 50, an ink tank 60 which stores ink to be supplied to the liquid ejection head 50, an ink introduction tube 61 for introducing ink from the ink tank 60 into the liquid ejection head 50, an ink extraction tube 62 for leading ink from the liquid ejection head 50 to the ink tank 60, and a circulation pump 63 provided at an intermediate position in the ink extraction tube 62

An example is depicted in which the circulation pump 63 is provided to the exterior of the liquid ejection head 50, but it is also possible to adopt a composition in which the circulation pump 63 is provided in the liquid ejection head 50. Providing the circulation pump 63 to the exterior of the liquid ejection head 50 as in the present example is desirable in that this composition makes it possible to achieve a large circulation volume.

Furthermore, although not shown in the drawings, rather than mixing the ink which returns to the ink tank 60 from the liquid ejection head 50 via the ink extraction tube 62 directly with the ink inside the ink tank 60, it is also possible to provide a filter in the ink extraction tube 62 in order to remove dirt from the ink in the ink extraction tube 62, and furthermore, it is also possible to provide an ink viscosity adjustment unit which performs adjustment in order to return the ink to its original viscosity, by adding water to the ink in the ink extraction tube 62.

Furthermore, the image forming apparatus 80 also comprises a cap 64 which seals the nozzle surface 510 of the liquid ejection head 50, and a wiping member 66 which forms a device for cleaning the nozzle surface 510 of the liquid ejection head 50. The cap 64 is used as a device for preventing the drying of the meniscus in the nozzles 51 of the liquid ejection head 50 during a prolonged idle period without performing ejection, as a device for preventing increase in the viscosity of the ink in the vicinity of the meniscus, and as a suctioning cap for suctioning ink from the nozzles 51 of the liquid ejection head 50. A maintenance unit including the cap 64 and the wiping member 66 are configured to be able to move relatively with respect to the liquid ejection head 50 by a movement mechanism (not shown), and is moved from a predetermined holding position to a maintenance position below the liquid ejection head 50 as required.

Furthermore, the cap 64 is displaced up and down relatively with respect to the liquid ejection head 50 by an elevator mechanism (not shown). The elevator mechanism is configured such that the cap 64 is raised to a predetermined elevated position so as to come into close contact with the liquid ejection head 50, and the nozzle face 510 is thereby covered with the cap 64. A suction pump 67 suctions ink from the nozzles 51 of the liquid ejection head 50 and sends the suctioned ink to a waste ink tank 68 in a state where the nozzle surface 510 of the liquid ejection head 50 is sealed by the cap 64. A suction operation of this kind is carried out when ink is filled into the liquid ejection head 50 from the ink tank 60 (initial filling), and it is also carried out when removing ink of increased viscosity after the apparatus has been out of use for a long period of time (start of use after long period of inactivity).

Figure 17:
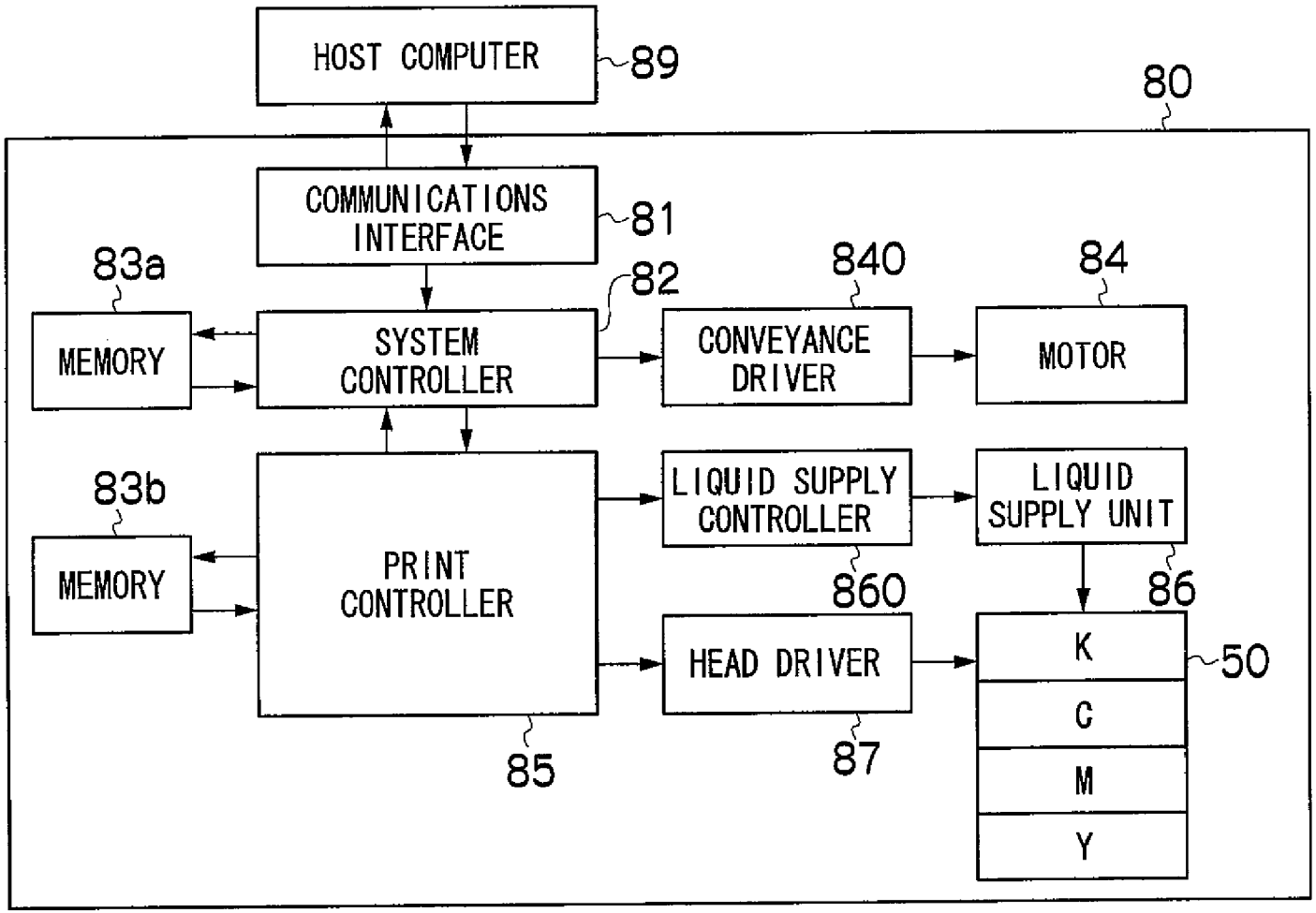
FIG. 17 is a block diagram showing the composition of the control system of an image forming apparatus which is one example of a liquid ejection apparatus.

FIG. 17 is a block diagram showing the control system of an image forming apparatus 80 comprising the liquid ejection head according to an embodiment of the present invention.

In FIG. 17, the image forming apparatus 80 chiefly comprises: a liquid ejection head 50, a communications interface 81, a system controller 82, memories 83*a*, 83*b*, a conveyance motor 84, a conveyance driver 840, a print controller 85, a liquid supply unit 86, a liquid supply control unit 860 and a head driver 87.

The image forming apparatus 80 has a total of four liquid ejection heads 50, one for each color of black (K), cyan (C), magenta (m) and yellow (Y).

The communications interface 81 is an image input device that receives image data sent from a host computer 89. It is possible to use a wired or wireless interface for the communications interface 81. The image data acquired by the image forming apparatus 80 via this communications interface 81 is stored temporarily in the first memory 83*a* which is used to store image data.

The system controller 82 is constituted by a microcomputer and peripheral circuits thereof, and the like, and it forms a main control device which controls the whole of the image forming apparatus 80 in accordance with prescribed programs. More specifically, the system controller 82 controls units such as the communications interface 81, the conveyance driver 840, the print controller 85, and the like.

The conveyance motor 84 supplies a motive force to the roller and belt, and the like, in order to convey an ejection receiving medium such as paper. The ejection receiving medium and the liquid ejection heads 50 are moved relatively with respect to each other, by means of this conveyance motor 84. The conveyance driver 840 is a circuit that drives the conveyance motor 84 in accordance with commands from the system controller 82.

The liquid supply unit 86 comprises an ink introduction channel (reference numeral 61 in FIG. 16) for introducing ink from an ink tank (reference numeral 60 in FIG. 16) to a liquid ejection head 50, an ink extraction tube 62 for extracting ink from the liquid ejection head 50 to the ink tank 60, and a circulation pump (reference numeral 63 in FIG. 16).

The liquid supply control unit 86 is constituted by a microcomputer and peripheral circuits of same, and it controls the supply of ink to the liquid ejection head 50, by means of the liquid supply unit 86. In the present embodiment, the liquid supply control unit 86 uses the circulation pump 63 of the liquid supply unit 86 as a liquid flow creating device, and performs the liquid flow forming control to control the creation of a liquid flow in the common flow channel 55 of the liquid ejection head 50.

The print controller 85 generates the data (dot data) on the basis of the image data input to the image forming apparatus 80. The dot data is necessary for forming dots on an ejection receiving medium by ejecting liquid droplets from the liquid ejection head 50 onto the ejection receiving medium. More specifically, the print controller 85 functions as an image processing device for performing various tasks, compensations, and other types of processing for generating dot data for ejecting droplets on the basis of the image data stored in the first memory 83*a*, in accordance with commands from the system controller 82, and supplies the generated dot data to the head driver 87.

The print controller 85 is accompanied with the second memory 83*b*, and dot data and other data are temporarily stored in the second memory 83*b* when image is processed in the print controller 85.

The aspect shown in FIG. 17 is one in which the second memory 83*b* accompanies the print controller 85; however, the first memory 83*a* may also serve to accomplish the functions of the second memory 83*b* and may be used instead of the second memory 83*b*. Also possible is an aspect in which the print controller 85 and the system controller 82 are integrated to form a single processor.

The head driver 87 outputs ejection drive signals to the piezoelectric elements 24 of the liquid ejection head 50 on the basis of the dot data supplied by the print controller 85 (in practice, the dot data stored in the second memory 83*b*). By supplying the ejection drive signals output from the head driver 87, to the piezoelectric elements 24 of the liquid ejection heads 50, liquid (droplets) are ejected from the nozzles 51 of the liquid ejection heads 50 toward the ejection receiving medium.

Sequence of Processing

Figure 18:
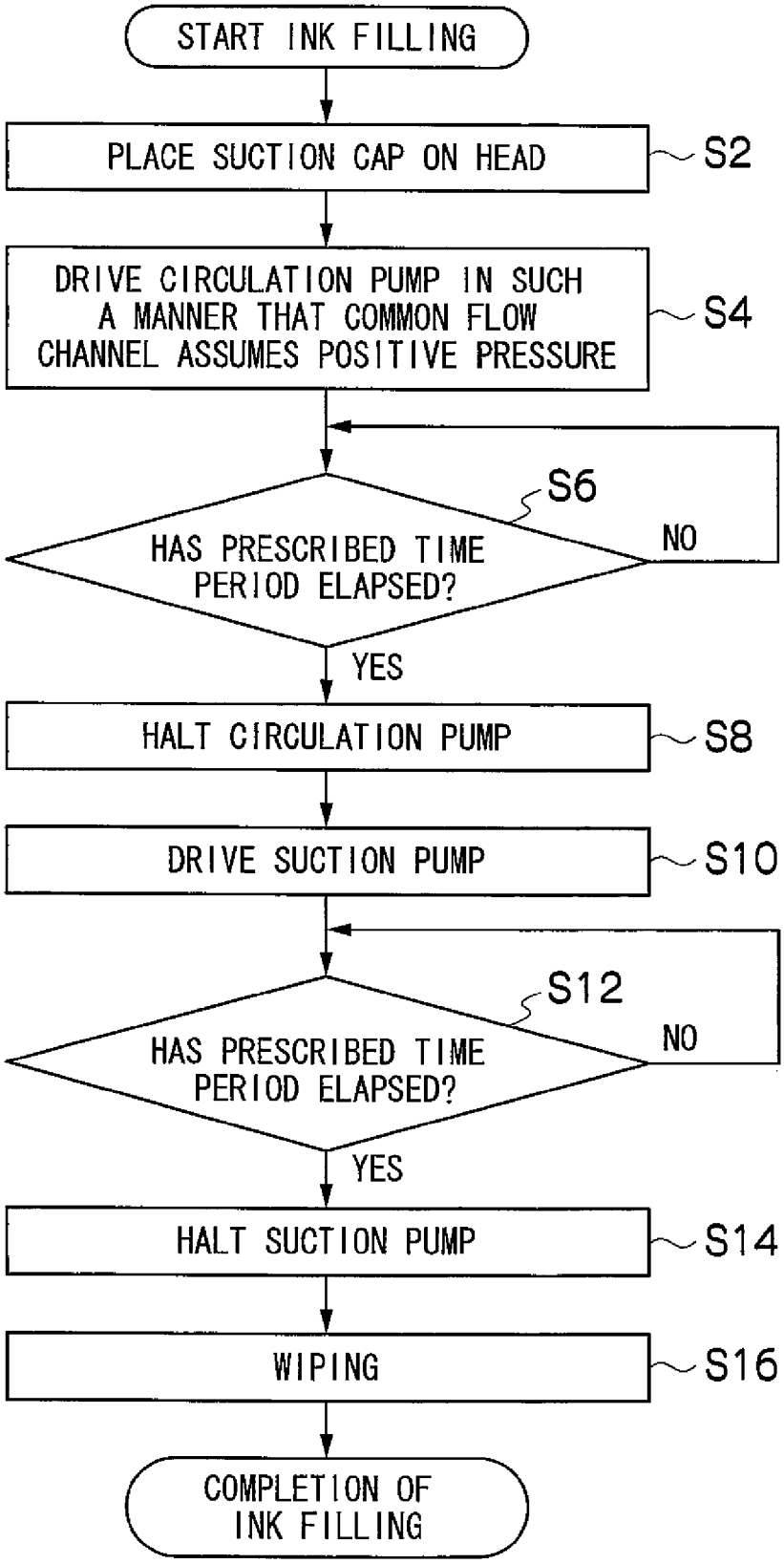
FIG. 18 is a general flowchart showing the sequence of an ink refilling process.

FIG. 18 is a general flowchart showing the sequence of one example of an ink refilling process for a liquid ejection head 50. Here, an example is described in which the ink refilling process shown in FIG. 18 is carried out when the power to the image forming apparatus 80 is switched on (during initial filling), or when ejection has not been carried out for a long period of time (in other words, when use is restarted after a long idle period).

The liquid supply control unit 860 shown in FIG. 17 starts the ink refilling processing shown in FIG. 18 when an ink refilling instruction is issued by the system controller 82. This processing is carried out by the microcomputer which constitutes the liquid supply control unit 860, in accordance with prescribed programs.

Firstly, the nozzle surface 510 of the liquid ejection head 50 is sealed with the suction cap (64 in FIG. 16) (S2).

Thereupon, the circulation pump (63 in FIG. 16) is driven in such a manner that the interior of the common flow channel 55 of the liquid ejection head 50 assumes a prescribed pressure (positive pressure) (S4); it is then judged whether or not a prescribed time period has elapsed (S6); and if the prescribed time period has elapsed, then the driving of the circulation pump 63 is halted (S8).

Subsequently, the suction pump (67 in FIG. 16) is driven (S10); it is judged whether or not a prescribed period of time has elapsed (S12); and if the prescribed period of time has elapsed, then the driving of the suction pump 67 is halted (S14).

Thereupon, the nozzle surface 510 of the liquid ejection head 50 is wiped with a wiping member (66 in FIG. 16) (S16). In so doing, the ink refilling process is completed.

Figure 19:
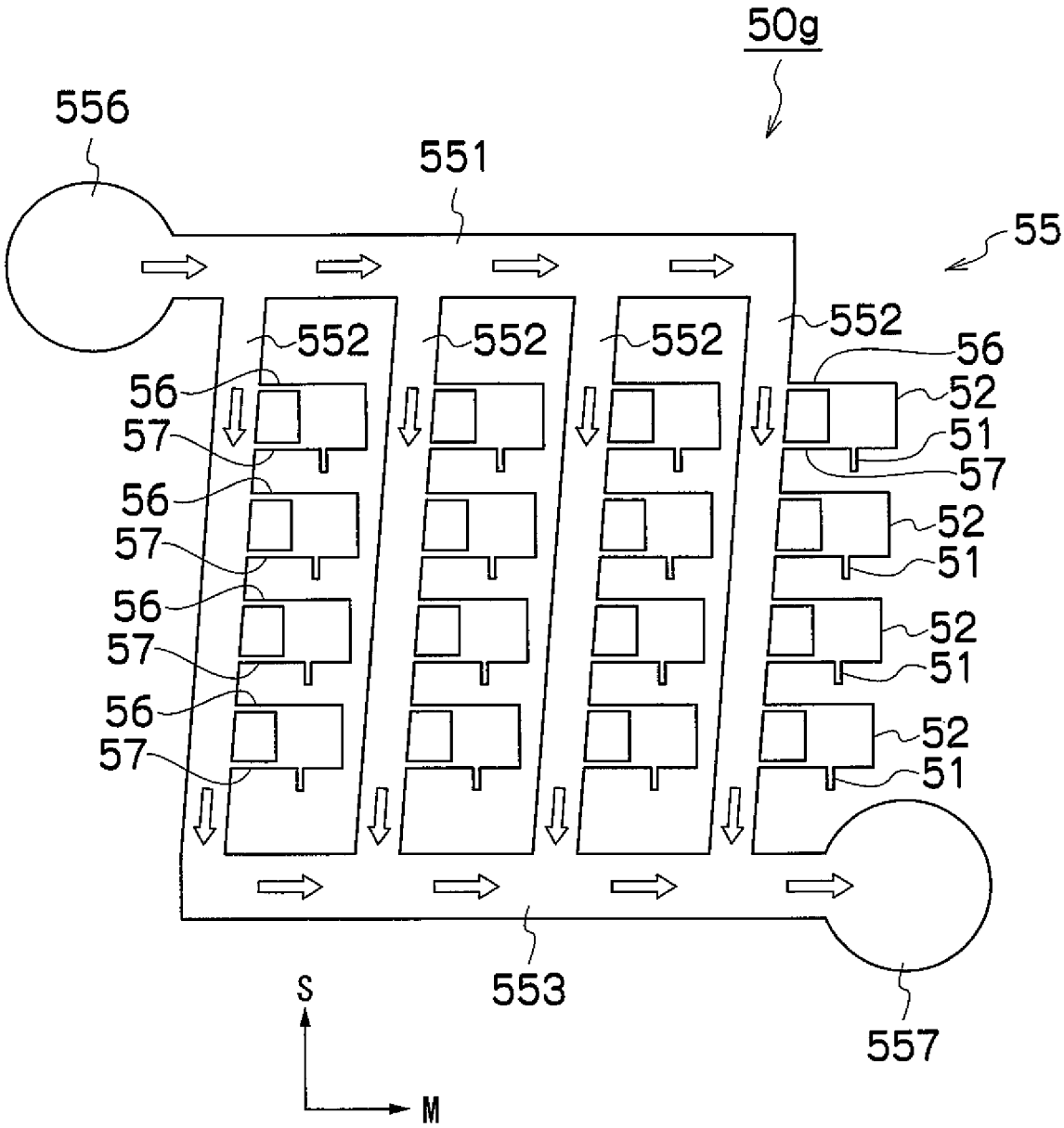
FIG. 19 is a perspective diagram showing the composition of a liquid ejection head having a matrix structure.
Figure 20:
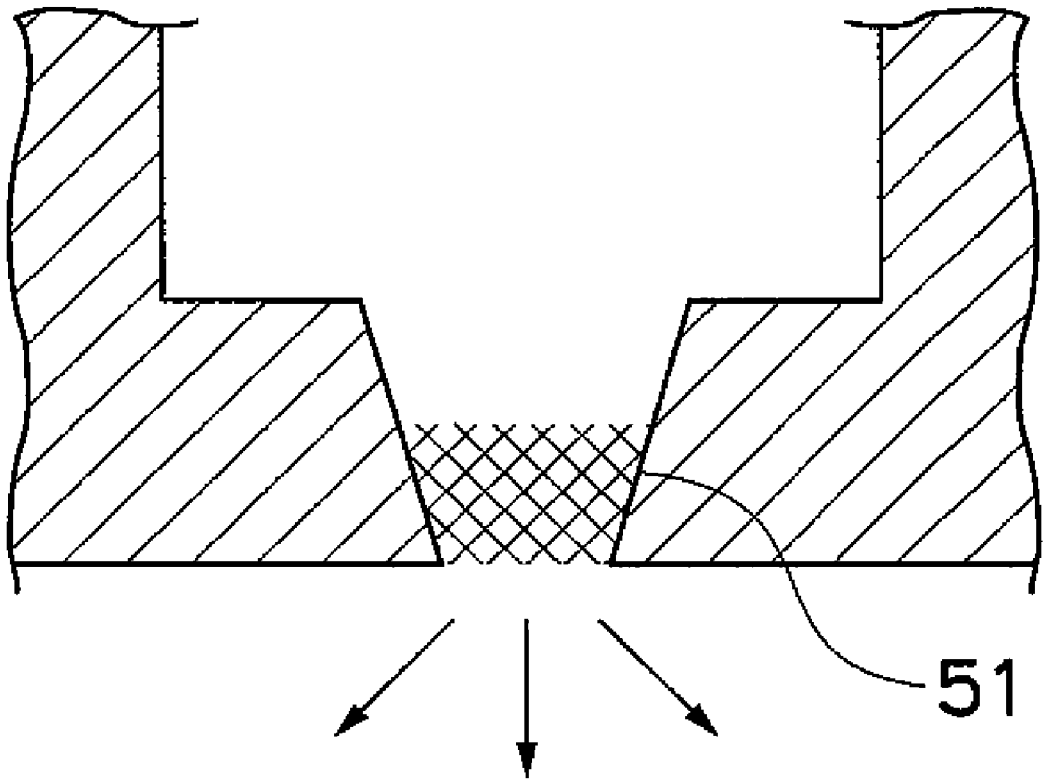
FIG.20 RELATED ART
FIG. 20 is an illustrative diagram used to describe increase in the viscosity of ink caused by evaporation of solvent from the nozzles.

The ink refilling process is not limited in particular to the ink refilling process shown in FIG. 19, but desirably, firstly ink is refilled into the ink circulation flow channel (57 in FIG. 1), whereupon ink is then refilled into the pressure chambers (52 in FIG. 1).

Furthermore, the circulation of ink from the common flow channel 55 to the ink tank 60 due to the driving by the circulation pump 63 is not limited to being carried out when the power to the image forming apparatus 80 is switched on (during initial filling) or when the apparatus starts to be used after a prolonged idle period. For example, it is also possible to cause ink to circulate only between pages, when the paper is being conveyed, and it is also possible to circulate the ink when it is judged on the basis of the image data that the ejection volume is smaller than a previously determined prescribed value. Furthermore, it is also possible to circulate the ink when the power supply is switched off. A combination of these methods may also be used.

Furthermore, it is desirable that the circulation of ink caused by the driving of the circulation pump 63 should also be carried out during ejection by the liquid ejection head 50 (during image formation). In other words, it is desirable that ink should be made to flow in the common flow channel 55 during ejection by the liquid ejection head 50.

If a pressure differential arises in this way between the ink supply ports 560 and the ink circulation ports 570 in the common flow channel 55, during ejection by the liquid ejection head 50, then a merit is also obtained in that the refilling of ink into the pressure chambers 52 is thereby aided. In other words, a combined effect can be expected in that in addition to preventing increase in viscosity, it is also possible to assist refilling.

If there is no flow of ink during ejection, then the refilling driving force is created by the capillary force of the nozzle 51 sections. In this case, if the flow channel resistance from the ink tank 60 to the pressure chamber 52 is high, then a sufficient flow rate for refilling is not guaranteed, and therefore it may not be possible for the supply to keep pace with the ejection volume. If there is a flow of ink in the common flow channel 55, then ink is compulsorily replenished to the ink supply flow channels 56 which lead from the common flow channel 55 to the pressure chambers 52, and this is equivalent to reducing the flow channel resistance between the ink tank 60 and the pressure chambers 52. Therefore, a positive action on the refilling of ink into the pressure chambers 52 is obtained.

Liquid Ejection Head Having Matrix Structure

FIG. 19 is a plan perspective diagram showing the principal part of a liquid ejection head 50*g* having a matrix structure to which an embodiment of the present invention is applied. FIG. 19 shows an example of a matrix structure comprising a two-dimensional 4×4 arrangement of nozzles, in which four nozzles 51 are arranged in the main scanning direction M (the direction perpendicular to the medium conveyance direction S), and furthermore, four nozzles 51 are arranged in a direction which is oblique with respect to the main scanning direction (the approximate medium conveyance direction S). However, the nozzle configuration is not limited in particular to this matrix structure, and it is possible to provide any number of nozzles 51, according to requirements.

In FIG. 19, the liquid introduction port 556 is connected to the ink introduction tube 61 in FIG. 16, and is thereby linked to the ink tank 60 in FIG. 16 via this ink introduction tube 61. Furthermore, the liquid extraction port 557 is connected to the ink extraction tube 62 in FIG. 16, and is thereby linked to the ink tank 60 via this ink extraction tube 62.

A common flow channel 55 leading from the ink introduction port 556 to the ink extraction port 557 is formed in the liquid ejection head 50. The common flow channel 55 is constituted by an upstream section 551 which connects to the ink introduction port 556, midstream sections 552 (pressure chamber connection sections) to each of which a plurality of pressure chambers 52 are connected via ink supply flow channels 56 and ink circulation channels 57, and a downstream section 553 which connects to the ink extraction port 557. In the present example, one upstream section 551 and one downstream section 553 of the common flow channel 55 are disposed in the main scanning direction, and a plurality of midstream sections 552 of the common flow channel 55 are disposed following a direction (the approximate scanning direction S) which is oblique with respect to the main scanning direction M (the direction perpendicular to the medium conveyance direction), in other words, they are disposed following the direction of arrangement of pressure chambers 52. An ink supply flow channel 56 and an ink circulation channel 57 which are connected to the same pressure chamber 52 are connected to the same midstream section 552 of the common flow channel 55.

Even if it is sought to append a new common flow channel used exclusively for ink circulation (not illustrated), separately from the common flow channel 55 for supplying ink to the pressure chambers 52, in practical terms, it is difficult to append a new common flow channel of this kind, for reasons of space. This is because a new flow channel which is parallel to the common flow channel 55 for supplying ink must be provided additionally throughout the whole of the liquid ejection head 50. However, by applying embodiments of the present invention, it is sufficient to append an ink circulation channel 57 locally between the common flow channel 55 and each pressure chamber 52. In other words, even in the case of a matrix structure as described above, it is possible to obtain the combined benefits of preventing increase in the viscosity of the ink in the vicinity of the nozzles 51 and refilling ink into the pressure chambers 52, while saving space.

Examples are described above in which ink is ejected, but the present invention is not limited in particular to cases where ink is ejected, and it may also be applied to cases where a liquid other than ink is ejected, for example, a treatment liquid which is ejected before ejection of ink, or the like.

The present invention is not limited to the examples described in the present specification or shown in the drawings, and various design modifications and improvements may of course be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of nozzles which eject liquid;

a plurality of pressure chambers connected respectively to the plurality of nozzles;

a common flow channel which is provided to be shared by the plurality of pressure chambers and has a plurality of supply flow channel connection ports and a plurality of circulation flow channel ports;

a plurality of supply flow channels through which the liquid flows from the common flow channel to the plurality of pressure chambers via the plurality of supply flow channel connection ports; and a plurality of circulation flow channels through which the liquid flow from the plurality of pressure chambers to the common flow channel via the plurality of circulation flow channel ports, wherein the plurality of supply flow channel connection ports and the plurality of circulation flow channel ports are arranged so that a pressure differential of the liquid between the supply flow channel connection port and the circulation flow channel port which are connected to the same pressure chamber is equal in respect of all of the plurality of pressure chambers.

2. The liquid ejection head as defined in claim 1, wherein a distance, in a direction of flow of the liquid in the common flow channel, between the supply flow channel connection port and the circulation flow channel port which are connected to the same pressure chamber, is equal in respect of all of the plurality of pressure chambers.

3. The liquid ejection head as defined in claim 2, wherein, taking the distance between the supply flow channel connection port and the circulation flow channel port which are connected to the same pressure chamber to be L1, and taking a distance between the supply flow channel connection ports which are mutually adjacent and are connected respectively to the different pressure chambers, to be L2, then L1>L2 is satisfied.

4. The liquid ejection head as defined in claim 1, wherein the plurality of circulation flow channels are connected to lower portions of the common flow channel in terms of a vertical direction.

5. The liquid ejection head as defined in claim 1, wherein the plurality of supply flow channel connection ports and the plurality of circulation flow channel ports are arranged at substantially diagonally opposite positions of the common flow channel.

6. The liquid ejection head as defined in claim 1, comprising a plurality of superimposed plates including a nozzle plate in which the plurality of nozzles are formed and a circulation flow channel plate in which the plurality of circulation flow channels are formed, wherein the circulation flow channel plate is adjacent to the nozzle plate; and the common flow channel is formed in contact with the nozzle plate.

7. The liquid ejection head as defined in claim 6, wherein a height of the plurality of circulation flow channels is smaller than a thickness of the circulation flow channel plate.

8. The liquid ejection head as defined in claim 7, wherein the plurality of circulation flow channels are formed on a side adjacent to the nozzle plate, in terms of a thickness direction of the circulation flow channel plate.

9. The liquid ejection head as defined in claim 6, wherein rigid bodies are disposed in the common flow channel so as to surround the plurality of circulation flow channel connection ports.

10. The liquid ejection head as defined in claim 6, wherein rigid bodies are disposed in the common flow channel, and each of the rigid bodies are arranged between the supply flow channel connection ports which are mutually adjacent.

11. A liquid ejection apparatus comprising the liquid ejection head as defined in claim 1.

12. The liquid ejection apparatus as defined in claim 11, further comprising a liquid flow creating device which creates a flow of the liquid in the common flow channel while the liquid ejection head performs ejection of the liquid.

* * * * *